United States Patent [19]

Sniegowski et al.

[11] Patent Number: 4,847,563

[45] Date of Patent: Jul. 11, 1989

[54] DISTRIBUTORLESS IGNITION INTERFACE

[75] Inventors: John C. Sniegowski, Kenosha, Wis.; Craig F. Govekar, Gurnee, Ill.; Dennis G. Thibedeau, Franklin; Ron D. Geisler, Kenosha, both of Wis.

[73] Assignee: Snap-on Tools Corporation, Kenosha, Wis.

[21] Appl. No.: 218,092

[22] Filed: Jul. 12, 1988

[51] Int. Cl.[4] ..... F02P 17/00

[52] U.S. Cl. ..... 324/402

[58] Field of Search ..... 324/384, 378, 379, 380, 324/391, 402; 364/431.03, 431.04, 431.12; 73/116

[56] References Cited

U.S. PATENT DOCUMENTS

| | | | |
|---|---|---|---|
| 3,959,725 | 5/1976 | Capek . | |
| 3,990,302 | 11/1976 | Reeves et al. . | |
| 4,005,356 | 1/1977 | Trussell . | |
| 4,041,373 | 8/1977 | Maringer | 324/126 |
| 4,366,436 | 12/1982 | Everett et al. | 324/379 |
| 4,379,263 | 4/1983 | Everett et al. | 324/379 |
| 4,396,888 | 8/1983 | Everett et al. | 324/379 |
| 4,644,284 | 2/1987 | Friedline et al. | 324/397 |

OTHER PUBLICATIONS

Advertisement, "NOW! Test Distributorless Ignition with Your Present Scope Analyzer", *MOTOR/AGE,* Jun. 1988, p. 23.

Manual, Bear Automotive Service Equipment Company, "43-225 DIS (Direct Ignition System) Adapter", May, 1987.

Brochure, Sun Electric Corporation, "DI Link 200", 1987.

Brochure, Sun Electric Corporation, "Testing the General Motors Distributorless Ignition System", Sep. 1986.

Manual, Sun Electric Corporation, DIL-180, 1986.

Article, "Direct Ignition", Joe Woods, *Motor,* Jan. 1988, pp. 47-53.

Report, Ford Motor Company, "DIS Ignition System", Mar. 1988.

Manual, Toyota, "7M-GTE Distributorless Ignition", 1987.

"General Motors Computer Controlled Coil Ignition", *SAE Technical Paper,* R. F. Gardner et al, Feb. 24, 1986.

"GM C32 Ignition", *MOTOR/AGE,* Jan. 1985, pp. 53-56.

Manual 16020.05-1, 1987, General Motors, "1984-1988 GM Distributorless Ignition Systems Operation and Diagnostic Procedures", pp. 1-1 to 4-3.

*Primary Examiner*—Gerard R. Strecker
*Assistant Examiner*—Anthony L. Miele
*Attorney, Agent, or Firm*—Emrich & Dithmar

[57] ABSTRACT

A distributorless ignition interface unit for use with an engine analyzer for analyzing an internal combustion engine includes a processing circuit which responds to analog signals representing true and wasted firings for the cylinders of the engine under test to determine the number of cylinders of the engine and the polarity of the firing of each cylinder and to then characterize the engine by determining the order of the true and wasted firing signals produced during an engine cycle and for producing a parade pattern of true or wasted secondary signals for application to the engine analyzer.

28 Claims, 17 Drawing Sheets

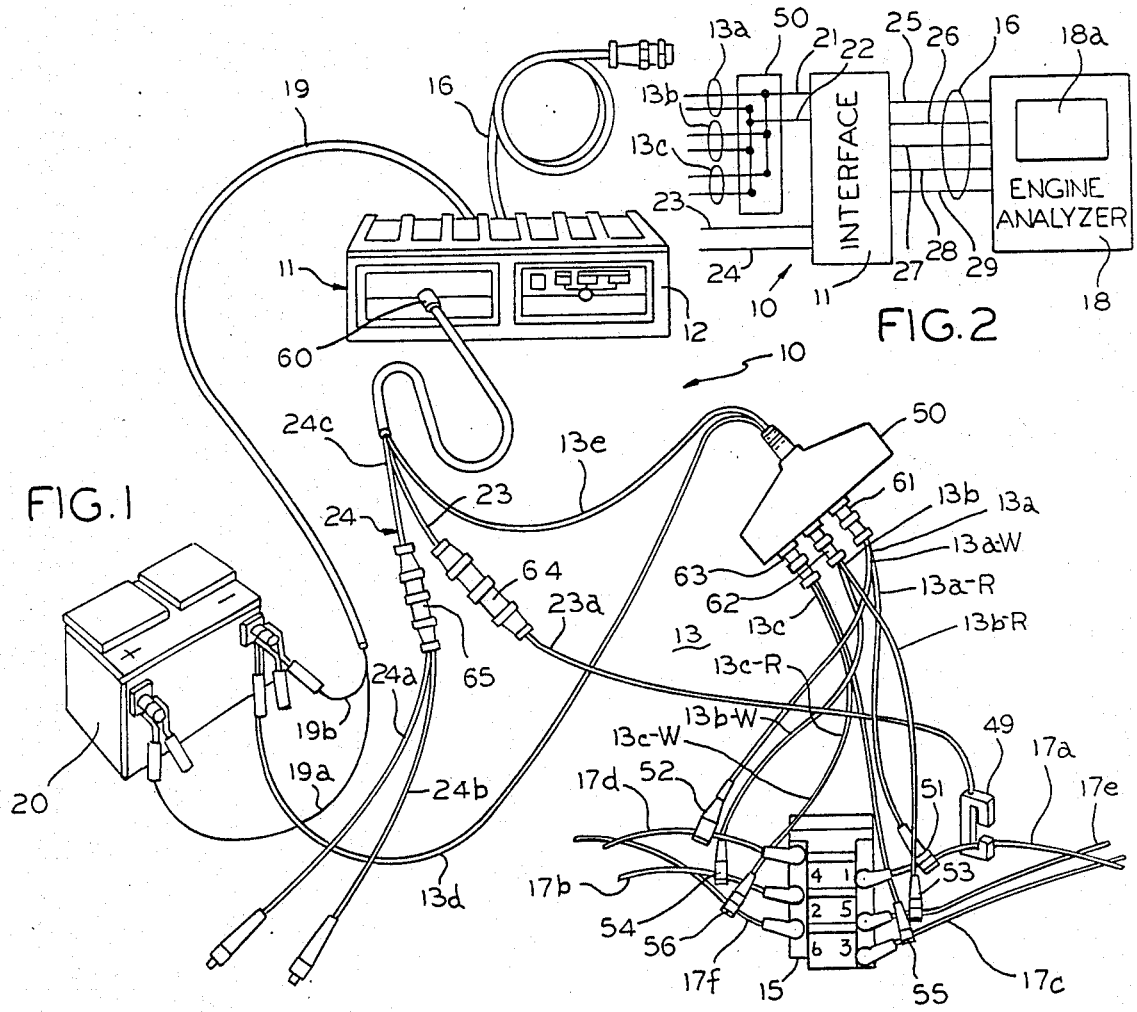
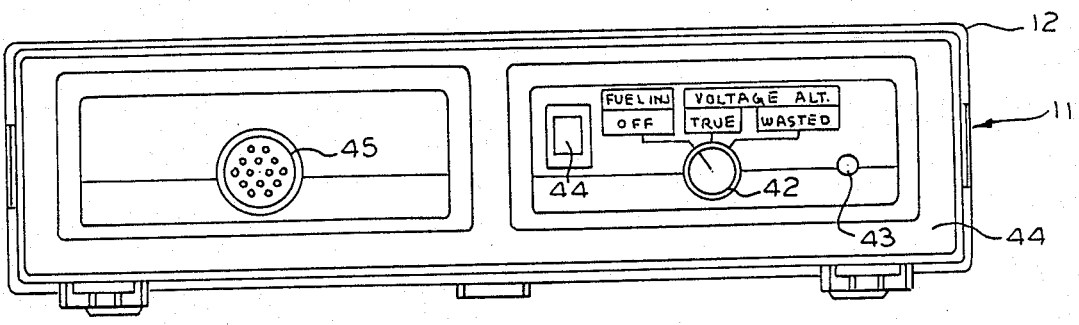
FIG. 7
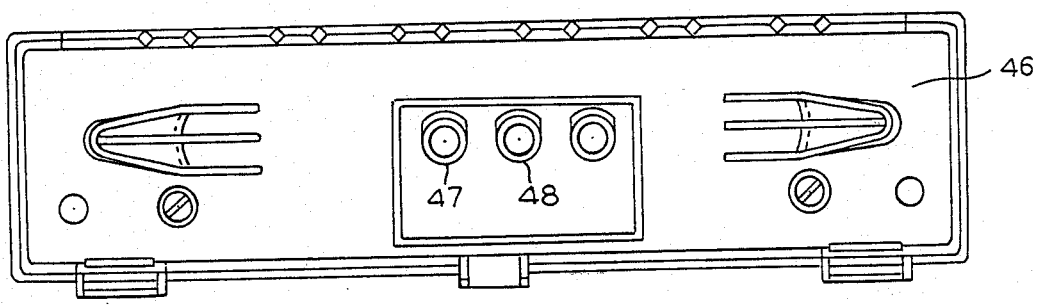
FIG. 8

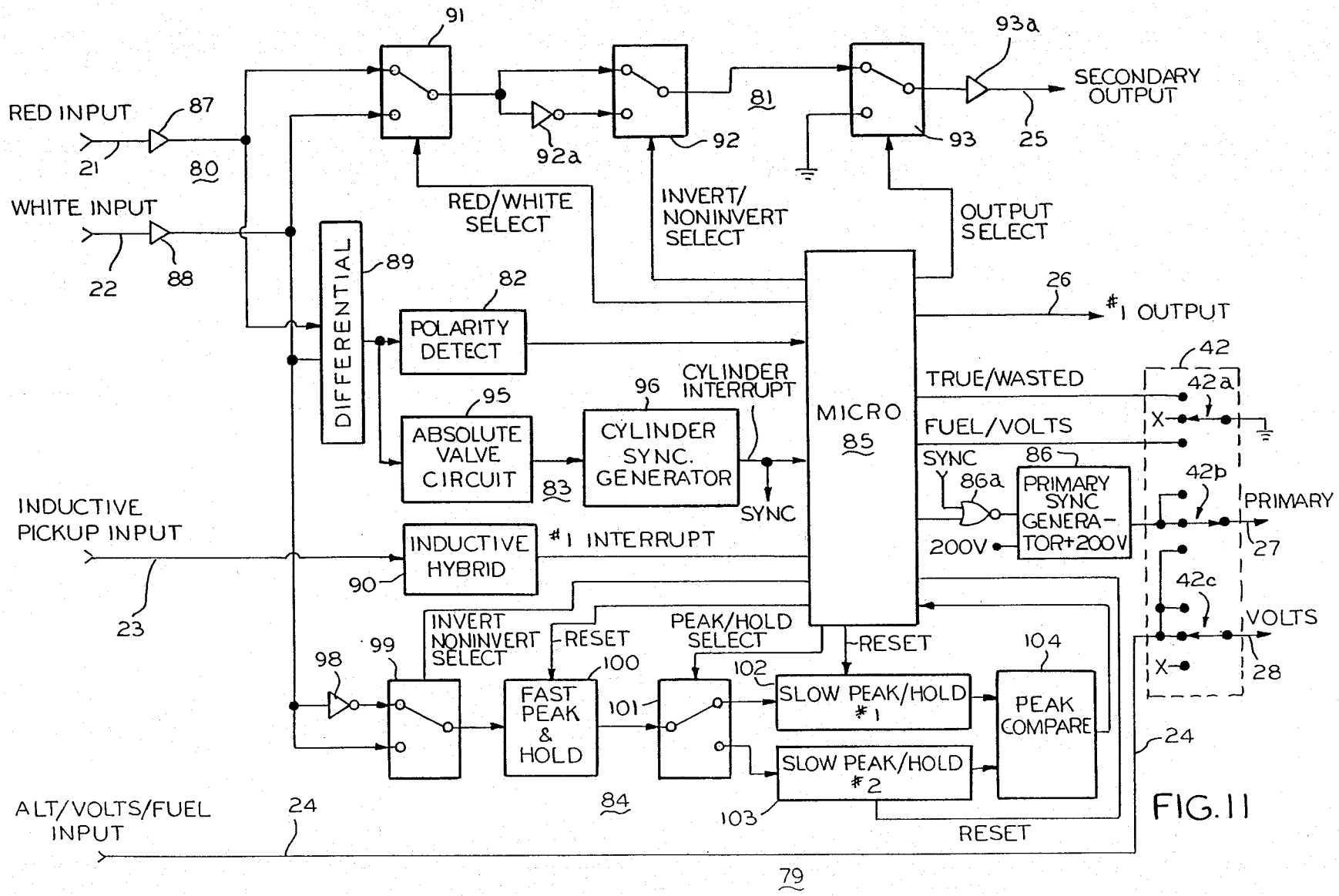
SECONDARY OUTPUT
93a
25
93
OUTPUT SELECT
26
#1 OUTPUT
42
42a
42b
42c
PRIMARY
27
VOLTS
28
24
FIG. 11
TRUE/WASTED
FUEL/VOLTS
SYNC
86
PRIMARY SYNC GENERATOR+200V
86a
200V
MICRO
85
RESET
104
PEAK COMPARE
SLOW PEAK/HOLD #1
SLOW PEAK/HOLD #2
RESET
79
81
92
INVERT/NONINVERT SELECT
CYLINDER INTERRUPT
SYNC
96
CYLINDER SYNC. GENERATOR
PEAK/HOLD SELECT
102
103
101
100
RESET
FAST PEAK & HOLD
84
92a
RED/WHITE SELECT
82
POLARITY DETECT
95
ABSOLUTE VALVE CIRCUIT
83
#1 INTERRUPT
INDUCTIVE HYBRID
INVERT NONINVERT SELECT
91
89
DIFFERENTIAL
90
99
98
24
87
80
88
RED INPUT
21
WHITE INPUT
22
INDUCTIVE PICKUP INPUT
23
ALT/VOLTS/FUEL INPUT

MAIN PROGRAM

NUMBER ONE INTERRUPT

CYLINDER INTERRUPT

TIMER INTERRUPT

TIMER SWITCH INTERRUPT

FINDING NUMBER OF CYLINDERS

ENGINE POLARITY

ENGINE CHARACTERIZATION

DISTRIBUTORLESS IGNITION INTERFACE

BACKGROUND OF THE INVENTION

This invention relates to internal combustion engine analyzers, and more particularly to a distributorless ignition interface for interfacing existing engine analyzers with distributorless ignition systems.

Until recently, ignition systems for internal combustion engines incorporated a distributor. However, the use of distributorless ignition systems is becoming more and more prevalent. Distributor type ignition systems consist of a single coil and a distributor to distribute sparks to individual spark plugs. Such systems provide only one firing per cylinder per engine cycle and all firings are of the same polarity. In contrast, waste spark distributorless ignition systems do not have a distributor and have one coil for every two cylinders, which are conventionally referred to as companion cylinders. Spark firings occur every engine revolution, or twice per engine cycle, with the spark plugs for companion cylinders firing at the same time from the same coil. This results in a compression firing and an exhaust firing for every cylinder for each engine cycle. The polarity in one cylinder is in the positive direction and the polarity in the companion cylinder is in the negative direction.

With a distributorless ignition system, there is no common point from which secondary or high voltage waveform signals for all cylinders can be coupled to an engine analyzer for analysis. In addition, there is no common primary circuit from which a primary or low voltage signal can be detected for all cylinders. Also, instead of one firing for each cylinder, there are two firings for each cylinder which occur 360° apart on crank rotation, one cylinder firing in the compression cycle and one cylinder firing in the exhaust cycle. Because of these distinctions, it is not possible to use engine analyzers designed for analyzing internal combustion engines having conventional distributor type ignition systems in analyzing the operation of internal combustion engines having distributorless ignition systems without adapting the existing engine analyzer to respond to a distributorless ignition systems.

Conventionally, internal combustion engines employing a distributorless ignition system have an electronic control module which is located in the passenger compartment or under the hood. The control module controls sequential energization of a set of coils located in a housing, commonly referred to as a coil pack, and mounted in close proximity to the engine. A wiring harness and associated connectors interconnect the electronic control module to the coil pack to extend energizing signals to the coils in sequence for firing spark plugs connected in series with the coil secondary windings. This connection is made at the coil pack. However, it is often very difficult to gain access to the coil pack. In some cars, the coil pack is underneath the engine, for example.

Distributorless ignition adapters have been proposed. However, most of the known adapters require disconnection of the electronic control module from the coil pack and connection of the distributorless ignition adaptor between the coil pack and the electronic control module. These adapters must be connected in circuit with the control modules because the adapters derive operating signals from the control module. Connection of the adaptor in circuit with the control module on the car is a very time consuming and difficult process. It may take forty-five minutes to connect the adapter in circuit with the control module.

One known distributorless ignition adaptor does not require connection to the control module and thus obviates the need for disconnecting the electronic control module from the coil pack. However, in use of this adaptor, it is critical how the probes are connected to the engine. If the probes are not connected to the proper spark plugs, the adaptor will not work. Also, information indicative of the type of engine under analysis must be entered into the unit. Moreover, the test lead harness includes a terminal block and six test leads which are permanently connected thereto. Thus, if a test lead becomes damaged, the entire harness must be replaced.

Known distributorless ignition adapters are characterized by the common shortcoming that they can only be used in testing certain engines.

SUMMARY OF THE INVENTION

It is therefore an important object of the present invention to provide a distributorless ignition interface unit for use with an engine analyzer which has the ability to characterize the engine irrespective of the manner in which connection is made to the spark plug wires.

Another object of the invention is to provide a distributorless ignition interface unit for use with an engine analyzer which does not require programming into the interface unit characteristics of the engine under test.

Another object of the invention is to provide a distributorless ignition interface unit for use with an engine analyzer which automatically determines the polarity of the secondary waveform signals produced in the spark plug wires during firing of the spark plugs.

Another object of the invention is to provide a distributorless ignition interface unit for use with an engine analyzer which automatically determines the location of true and wasted firings.

A further object of the invention is to provide a distributorless ignition interface unit for use with an engine analyzer which generates a simulated primary synchronization signal for synchronizing operation of the interface unit and the engine analyzer.

A further object of the invention is to provide a distributorless ignition interface unit for use with an engine analyzer including a wiring harness which includes a terminal block having a plurality of individually removable connecting leads each of which lends itself to replacement should a lead become damaged in use.

A further object of the invention is to provide a distributorless ignition interface unit for use with an engine analyzer which does not require connection to the electronic control module of an electronic ignition engine system for generation.

Another object of the invention is to provide a distributorless ignition interface unit for use with an engine analyzer which automatically determines when the engine is running, the number of cylinders of the engine and the polarity of the engine.

Another object of the invention is to provide a distributorless ignition interface unit for use with an engine analyzer which is usable on most internal combustion engines having a distributorless ignition system.

These and other objects are achieved by the present invention which provides a distributorless ignition interface unit for use with an engine analyzer for analyzing an internal combustion engine which produces a series of analog signals including positive polarity signals representing true and wasted firings for a first plurality of cylinders of the engine and negative polarity signals representing true and wasted firings for a second plurality of cylinders of the engine, comprising waveform selection means for conducting the analog signals from an input of the interface unit to an output of the interface unit; means responsive to the analog signals for determining the number of cylinders of the engine; polarity detect means responsive to the analog signals for determining the polarity of each analog signal; characterization means responsive to the analog signals for determining the order of the analog signals representing true and wasted firings in the series; and processing means responsive to said characterization means, said means for determining the number cylinders and to said polarity detect means for controlling the waveform selection means for conducting selected ones of the signals of the series of signals to the output of the interface unit.

In accordance with an aspect of the invention, there is provided a method for analyzing an internal combustion engine having a distributorless ignition system which produces analog signals representing true and wasted firings for each cylinder of the engine during each engine cycle, the signals being produced in a series of signals with certain ones of the signals having negative polarities and the remaining signals having positive polarities, the method comprising generating a timing signal indicative of the duration of an engine cycle; determining the number of analog signals produced by the engine during a given engine cycle; determining the polarity of each analog signal produced by the engine under test during a given engine cycle; characterizing the engine by determining the order of the true and wasted firings for at least certain ones of the cylinders during at least one engine cycle; and selecting certain ones of the analog signals to be extended to the engine analyzer in a series as a function of number of cylinders, the polarity of the signals and the characterization of the engine.

The present invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

FIG. 1 is an isometric view of the distributorless ignition interface unit provided by the present invention illustrating connections of the wiring harness to the engine and to the vehicle battery of a vehicle under test;

FIG. 2 is a block diagram illustrating the signal inputs to and the signal outputs from the interface unit and connections to an engine analyzer;

FIG. 7 is a front elevational view of the interface module of the interface unit;

FIG. 8 is a rear elevational view of the interface module;

FIG. 11 is a block diagram of the electronic circuits of the interface module;

FIGS. 11, 12 and 13 are to be arranged;

DESCRIPTION OF THE PREFERRED EMBODIMENT

Figure 3:
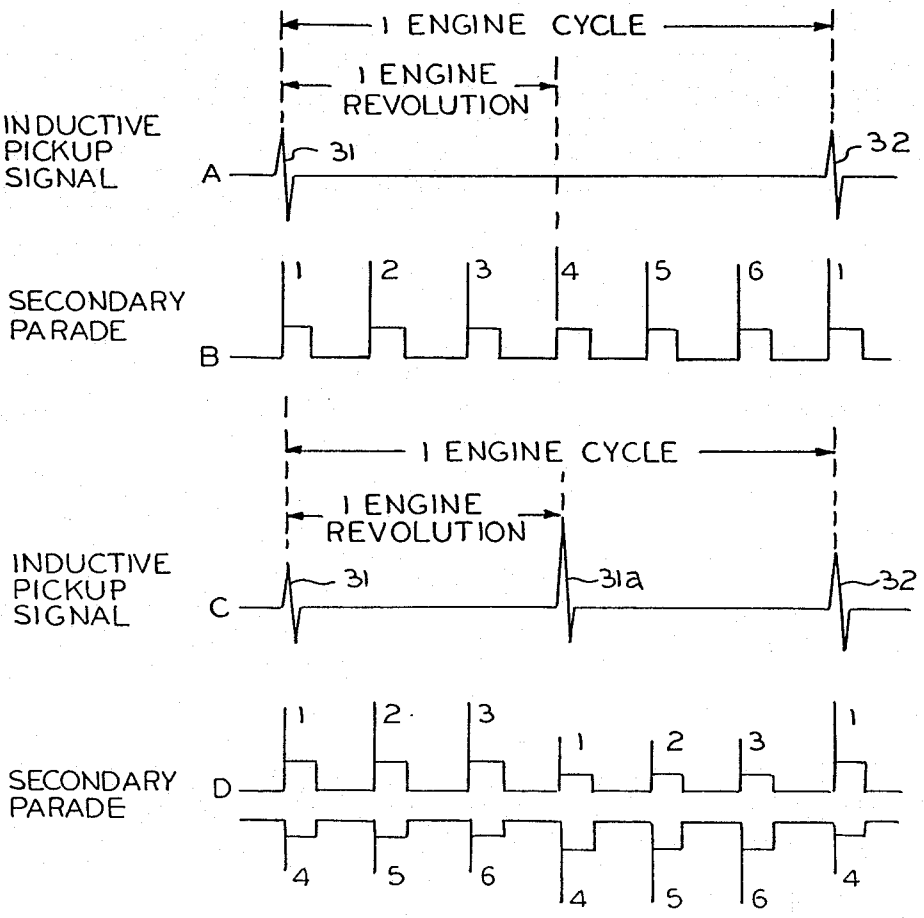
FIG. 3 is a timing diagram illustrating simplified representations of waveforms for secondary signals for a distributor type ignition system and a distributorless ignition system.

Referring to FIGS. 1 and 2, the distributorless ignition interface unit provided by the present invention is indicated generally by reference numeral 10 and includes an interface module 11 including a housing 12 which encloses electronic circuitry to be described. An input harness 13 which is connected to an internal combustion engine 15 under test, extends analog signals produced by the engine to the interface module. An output cable 16 connects the interface module to an engine analyzer 18 for extending analog signals to the engine analyzer. A power lead set 19 connects to the vehicle battery 20 for energizing the interface module 11.

The interface unit 10 is described as being used with the digital engine analyzer which is disclosed in the U.S. Patent Application Ser. No. 89,241, filed Oct. 9, 1987 and which is assigned to the assignee of the present application. The digital engine analyzer 18 is fully described in the referenced patent application which is incorporated herein by reference. The interface unit 10 adapts the engine analyzer 18 for use in testing and analyzing the operation of internal combustion engines having a distributorless ignition system. The engine analyzer has a display screen 18*a* for displaying waveforms and other information in analyzing an internal combustion engine.

As described in the referenced patent application, the analog signals supplied to the engine analyzer include a number one sync pulse, primary and secondary ignition signals, and alternator/voltage signals. An inductive pick-up lead which clamps over the number one spark plug wire on the engine being analyzed provides the number one sync signal which serves as a reference for identifying cylinders. A lead connected to a terminal of the distributor or of the fuel injector, depending on the test being performed, monitors the primary ignition signal which is used in determining ignition dwell, fuel injection performance and for conducting cylinder shorting test modes. A capacitance pick-up lead which clamps over the coil wire on remote ignition coil type systems senses the high-voltage surges from the secondary of the ignition coil that will be distributed to each of the spark plugs, producing the secondary waveform signals for the display by the engine analyzer. Another lead provides a connection to the alternator or battery or other voltage source of the engine, producing analog signals for testing the operation of the alternator and voltage level of the battery. The interface unit 10 provides these analog signals to the engine analyzer 18, enabling the engine analyzer to perform engine analysis as it wold for an engine equipped with a distributor type ignition system.

Briefly, the interface unit receives from the engine under test analog engine signals including secondary waveform signals, the number one sync pulse and processes these signals to determine the number of cylinders that the engine has, the polarity of the cylinder firings and the order of true and wasted firings for the cylinders. The interface unit 10 produces a parade of secondary waveform signals such as would be produced by an engine equipped with a distributor-type ignition system by separating the secondary waveform signals for the true and wasted firings for each cylinder and inverting negative polarity signals to produce a parade of secondary waveform signals consisting of a series of cylinder true firing signals or cylinder wasted firing signals all of the same polarity as selected by the mechanic. The signals produced by the interface unit 10 are applied to the engine analyzer, along with alternator and battery voltage signals, for use in analyzing the operation of the engine under test. These analog signals enable the engine analyzer 18 to operate in each of its test modes as described in the referenced patent application, other than the cylinder shorting mode, and in the primary function and dwell bar graph modes, which are not applicable.

More specifically, with reference to FIGS. 1 and 2, the input harness 13 includes three lead sets 13*a*, 13*b*, and 13*c* each including a pair of capacitive pick-up leads 13*a*-R, 13*a*-W; 13*b*-R, 13*b*-W; and 13*c*-R, 13*c*-W, respectively. The lead sets are connected to the six spark plugs of the six cylinder engine. The leads 13*a*-R, 13*b*-R, and 13*c*-R are interconnected by a terminal block 50 providing a common lead 21 (FIG. 2). Leads 13*a*-W, 13*b*-W and 13*c*-W are interconnected by terminal block 50 providing a common lead 22 (FIG. 2). The interface module 11 receives from the engine under test secondary waveform signals over the leads 21 and 22. Lead 23 is an inductive pick-up lead having an inductive pick-up head 49 which is clamped on the spark plug wire 17*a* of the number one cylinder spark plug providing the number one sync pulse. Lead set 24 includes leads 24*a* and 24*b* which include clips for connection to the vehicle alternator, battery, or fuel injector respectively. Lead 13*d* is connected to ground terminal of the battery 20. The interface module 11 supplies to the engine analyzer 18, secondary waveform signals on lead 25, a number one sync pulse on lead 26, fuel injector signal, or a primary sync signal generated by the interface module on lead 27 and alternator/volt signals on lead 28. A ground lead 29 is connected between the interface 11 and the digital engine analyzer 18 to provide a common ground reference for the test apparatus. Leads 25-29 comprise output cable 16. The power lead set 19 includes leads 19*a* and 19*b* which are connected, respectively, to the positive terminal and negative terminal of the battery 20.

DISTRIBUTORLESS IGNITION OPERATION

Figure 4:
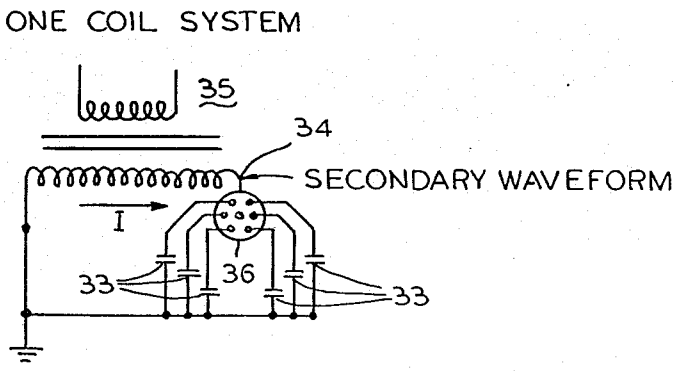
FIG. 4 is a simplified representation of a distributor system.
Figure 5:
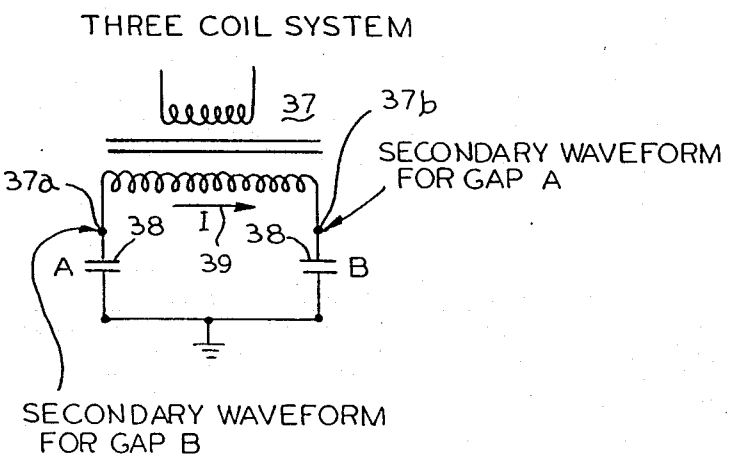
FIG. 5 is a simplified representation of a distributorless ignition system.

Before considering the operation of the interface module 11, it may be helpful to briefly review the principles of distributorless ignition system operation. With reference to FIGS. 3, 4 and 5, the major difference between distributorless ignition systems and conventional distributor ignition systems is that distributorless ignition systems fire all of the engine spark plugs producing the secondary waveform signals shown in simplified form in FIG. 3, line D in one crank shaft revolution, defined by number one sync pulses 31 and 31*a* (FIG. 3, line C) whereas the distributor equipped system uses two crank shaft revolutions, defined by number one sync pulses 31 and 32 (FIG. 3, line A) to fire all of the spark plugs producing the secondary waveform signals shown in simplified form in FIG. 3, line B. In most engines with an even numbers of cylinders (4-cylinders, 6-cylinders, 8-cylinders), combustion occurs in half of the cylinders in the first crank shaft revolution and in the other half of the cylinders in the second crank shaft revolution. Each cylinder that has combustion in the first revolution has a "companion" cylinder that fires 360° apart from it during the second revolution.

Referring to FIG. 4, distributor systems are known as one coil systems with the spark plugs 33 connected in series with the secondary winding 34 of coil 35. A distributor 36 distributes the high voltage signal to the various spark plugs 33 connected thereto, one at a time, with rotation of the engine, for firing the spark plugs in sequence.

In a distributorless ignition system, multiple coils are employed, each controlling the firing of two spark plugs which are connected in series. In FIG. 5, only one coil 37 is shown, but for a 6-cylinder engine, three such coils would be employed, each firing two spark plugs 38. Each coil 37 has two secondary terminals 37*a*, 37*b* that are connected to the spark plugs 38 of companion cylinders. The spark plugs 38 are connected in a series circuit, the circuit being completed through the engine chassis or ground. Assuming the direction of current flow shown by the arrow 39 in FIG. 5, one spark plug will be fired from the coil to ground, hereinafter referred to as a positive firing and the other spark plug will be fired from ground to the coil, hereinafter referred as a negative firing. The coil fires both spark plugs at the same time every crank shaft revolution. One of the spark plug firings is called a "true" firing because it occurs in the cylinder during the compression stroke and ignites the air/fuel mixture. The other is called a "wasted" firing because it occurs during the exhaust stroke and does not ignite an air/fuel mixture. In other words, combustion occurs in each cylinder every two crank shaft revolutions, just the same as it occurs on engines equipped with distributor ignition systems. Ignition timing is controlled by Hall effect sensors or variable reluctance magnetic pick-up-sensors as is known in the art. The sensor input signals are sent to an electronic ignition control or module which uses this input to trigger the ignition systems primary circuit on and off at precise times in the engine cycle.

Referring again to FIG. 3, there is illustrated simplified representations of the secondary waveform for a distributor type ignition system for one engine cycle. For purpose of illustration only, it is assumed that the cylinders fire in the sequence 1-2-3-4-5-6. As shown, for a conventional distributor type system, all secondary pulses are positive. The secondary waveform signals for firing of cylinders 1, 2 and 3 occur in the first engine revolution and the secondary signals for cylinders 4, 5 and 6 occur in the second engine revolution of the engine cycle. The engine cycle is defined by successive number one sync pulses 31 and 32 (FIG. 3, line A) for positive firings of the number one cylinder in the firing order. As shown in FIG. 3, line C, two number one sync pulses 31, 31*a* are generated for each engine cycle. Pulse 31 is the "true" number one sync pulse and pulse 31*a* is the "wasted" number one sync pulse.

Cylinders 1 and 4 are companion cylinders. When cylinder 1 is in a compression stroke and fires for the power stroke, cylinder 4 is in the exhaust stroke. Because both spark plugs for companion cylinders fire at the same time, two secondary waveform signals are produced. As shown in FIG. 3, line D, the two waveforms are complementary in polarity and the waveform for the true firing is of greater amplitude than that for the wasted firing. The true and wasted waveforms must be separated to allow selection as to which waveform is to be extended to the engine analyzer 18 (FIG. 2).

Because the coil 37 controls the firing for two spark plugs 38 and because three separate coils are used for a 6-cylinder engine, there is no single point where at the secondary waveform signals can be sensed for all six cylinders. In accordance with a feature of the invention, the input lead harness includes a connector 50 (FIG. 2) which combines the six secondary waveform signals as shown in FIG. 6, lines A and B, on two leads 21,22 (FIG. 2) for application to the interface module 11.

Figure 6:
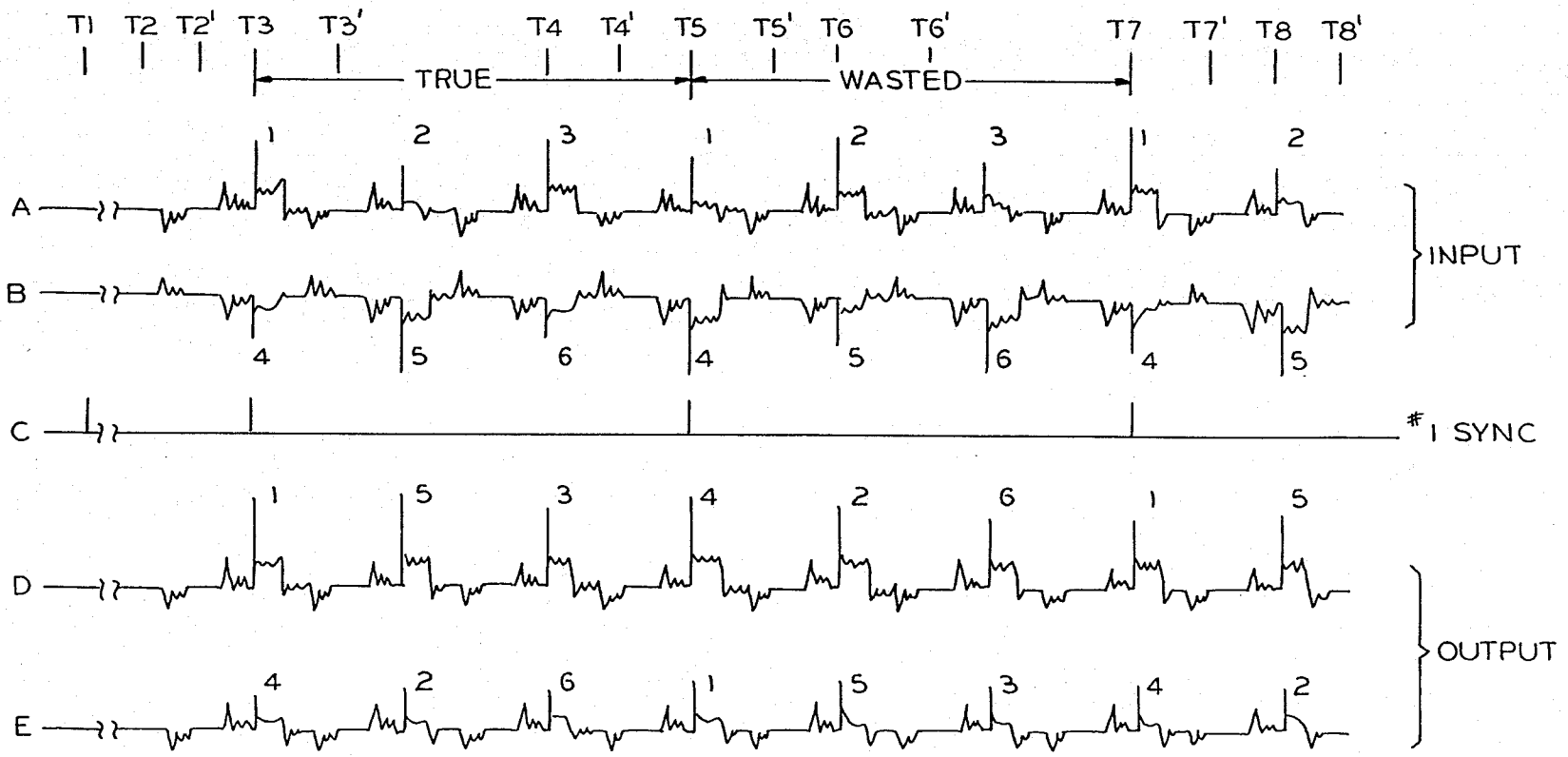
FIG. 6 is an illustration of input and output secondary waveform parade patterns for the interface unit.

Referring to FIG. 6, lines A and B illustrate the secondary waveforms for cylinder 1 through cylinder 6 produced by the internal combustion engine under test and applied to the interface module 11. For purposes of illustration, the firing order is assumed to be 1-5-3-4-2-6. As shown in FIG. 6, in line A, which illustrates secondary waveforms produced for positive firings for cylinders 1, 2 and 3, cylinder 1 provides a true firing, cylinder 2 provides a wasted firing and cylinder 3 provides a true firing during the first engine revolution. During the second revolution, cylinder 1 provides a wasted firing, cylinder 2 provides a true firing and cylinder 3 provides a wasted firing. As shown in FIG. 6, line B, which illustrates secondary waveform signals produced for negative firings, cylinder 4 provides a wasted firing, cylinder 5 provides a true firing and cylinder 6 provides a wasted firing during the first engine revolution. During the second engine revolution, cylinder 4 provides a true firing, cylinder 5 provides a wasted firing and cylinder 6 provides a true firing. It should be noted that the KV peak value for TRUE firings, typically 6 KV to 14 KV, is much greater than the KV peak value for WASTED firings, typically 1 KV to 2 KV. The waveforms shown are for purposes of illustration only and the polarities and sequences may be different as a function of engine, connection of the test lead sets, etc. Also, for convenience, the parade pattern is shown as having all positive components in line A and all negative components in line B, but, again, this is merely for purposes of illustration.

In accordance with one aspect of the invention, the interface module 11 automatically determines the polarity of the secondary waveform signals supplied thereto over leads 21 and 22 (FIG. 2), inverts the negative polarity signals, separates TRUE firing waveforms from wasted waveforms and produces either the output waveform pattern shown in FIG. 6, line C or the waveform pattern shown in line D, which are parade patterns of true firings and wasted firings, respectively. Only one output waveform pattern which is generated by the interface module and extended to the engine analyzer 18 (FIG. 2) is selectable by the operator. The operator has the option to display either the true firing secondary parade pattern or the wasted secondary parade pattern. The operator may operate the interface module in a fuel injector mode to display the fuel injector waveform patterns. In addition, with modification, the magnitude of the true and wasted firing signals, may be displayed.

Referring to FIG. 2, in distributorless ignition systems there is no common point from which primary waveform signals can be obtained. Accordingly, the interface module 11 generates a simulated primary sync signal which is passed over lead 26 to the engine analyzer 18. The primary sync signal as applied to the engine analyzer 18 prevents mistriggering of the engine analyzer during ringing portions of the secondary waveforms. This could cause misplacement of the KV peak value for the peak insertion function provided by the engine analyzer and a shifting of the waveform which could otherwise permit the peak insertion to be entered at the wrong point in the secondary waveform being processed by the engine analyzer.

INTERFACE MODULE

Referring to FIGS. 1, 2, 7 and 8, the interface module housing 12 has a front panel 41 which mounts a selector switch 42, an indicating device 43, such as a light emitting diode (LED), a reset push button 44 and an input harness receptacle 45 which receives the input harness 13. The interface module housing 12 has a back panel 46 which mounts an output cable receptacle 47 which receives the output cable 16 and a power lead receptacle 48 which receives the power lead set 19. The indicating device 43 is lit whenever the power leads 19 for the interface module are connected to the vehicle battery.

The selector switch 42 is a three-position switch that is used to select the desired operating mode for the interface module. Operating the selector switch 42 to the center position labelled TRUE causes the interface module 11 to conduct the true cylinder firing secondary waveforms to the engine analyzer 18 and the voltage or alternator signals are extended to the engine analyzer 18 to enable the VOLTAGE PATTERN or ALTERNATOR PATTERN screens for the engine analyzer 18. Operating the selector switch 42 to the right hand position labelled WASTED enables the interface module 11 to conduct the wasted cylinder firing secondary waveforms to the engine analyzer 18 and the voltage or alternator signals are extended to the engine analyzer 18 to enable the VOLTAGE PATTERN or ALTERNATOR PATTERN screens for the engine analyzer 18. Operating the selector switch 42 to the left hand position labelled OFF/FUEL INJ. inhibits the true and wasted cylinder firing test modes, but does not switch off power to the interface module 11. In this position the fuel injector waveform pattern is allowed from lead 24 to allow the engine analyzer 18 to provide the fuel injection screen.

Depressing and releasing the push button 44 generates a reset signal which causes the signal output of the interface module 11 to become ground level forcing a "straight-line" display on the screen 18*a* of the engine analyzer 18, restarts the signal processing cycle for the interface module 11. The signal output of the interface module 11 is held at ground level during initial characterization of the engine under test.

Referring to FIG. 1, in accordance with a feature of the invention, the lead sets 13*a*–13*c*, 23 and 24 of the input harness 13 are individually replaceable. Lead sets 13*a*–13*c* are connected to the terminal block 50 by connectors 61–63, respectively. Lead set 23 includes connector 64 which connectors lead 23*a* to lead portion 24*b* which terminates in plug 60. Lead set 24 includes connector 65 which connects leads 24*a* and 24*b* to lead portion 24*c* which terminates in plug 60.

The terminal block 50 accepts 1, 2, 3 or 4 lead sets and connects the lead sets to lead 13*e* which is connected to the interface module 11 by connector plug 60. One lead set is connected to the terminal block 50 for every two cylinders. In other words, a 4-cylinder engine requires two lead sets, a 6-cylinder engine requires three lead sets, and an 8-cylinder engine requires four lead sets.

Each of the lead sets 13*a*–13*c* has leads each with a capacitive pick-up in the form of a clip adapted for attachment to spark plug wires. For example, lead set 13*a* includes leads 13*a*-R and 13*a*-W having clips 51 and 52, respectively. Clip bases are color coded. Clip 51 has a red band at its base and clip 52 has a white band at its base. Proper connection of the lead sets 13*a*–13*c* to the spark plug wires is critical only to the extent that a red coded lead 13*a*-R of lead set 13*a* must connected to the number one cylinder spark plug wire 17*a* and the white coded lead 13*a*-W of the same lead set 13*a* must be connected to the spark plug wire 17*d* of the number one companion cylinder. Preferably the two lead sets 13*b* and 13*c* are connected to the spark plug wires leading from each coil with the red coded lead going to the spark plug wire of the odd numbered cylinder and the white coded test lead going to the plug of its companion cylinder, but if connections of the red and white coded leads for either or both of these two lead sets 13*b* and 13*c* are reversed, the interface module will still operate and be able to characterize properly the engine under test. In the example, only three lead sets are used, lead set 13*b* has leads 13*b*-R and 13*b*-W connected to spark plug wires 17*e* and 17*b* by clips 53 and 54. Lead set 13*c* has leads 13*c*-R and 13*c*-W connected to spark plug wires 17*c* and 17*f* by clips 55 and 56.

Figure 9:
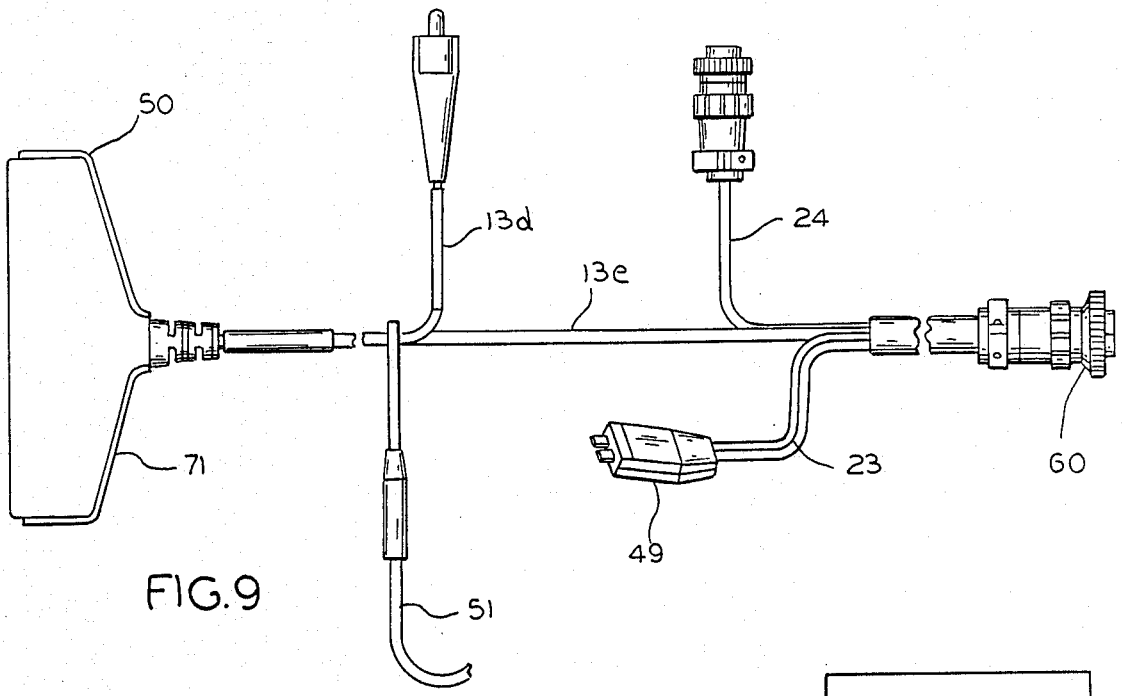
FIG. 9 is a plan view of the lead harness of the interface unit.
Figure 10:
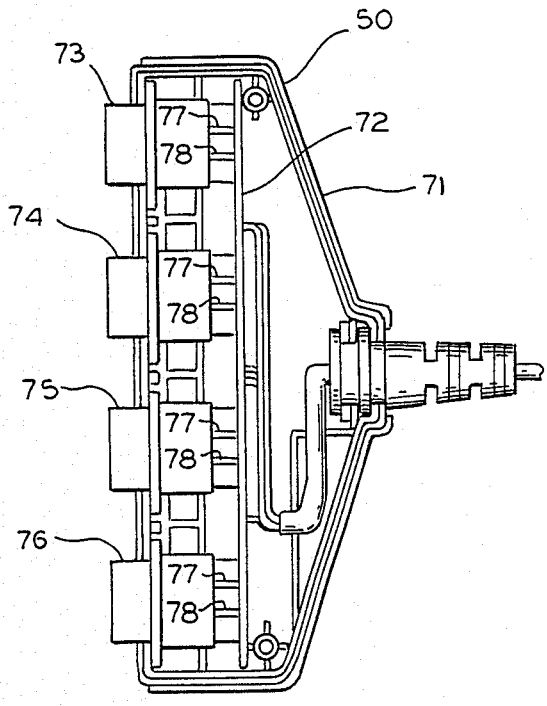
FIG. 10 is a sectional view of the terminal block of the lead harness.

Referring to FIGS. 9 and 10, the terminal block 50 includes a housing 71 in which is mounted a printed circuit board 72. The terminal block 50 further includes four receptacles 73–76 which are mounted on the printed circuit board 72 and have terminals 77 and 78 of each receptacle 73–76 interconnected in common by printed circuit conductors on the printed circuit board 72 such that when the lead sets 13*a*, 13*b* and 13*c* are plugged into the receptacles 73, 74 and 75, the red coded leads 13*a*-R, 13*b*-R and 13*c*-R are all interconnected and the white coded leads 13*a*-W, 13*b*-W and 13*c*-W are all interconnected for application to respective input leads 21 and 22 of the interface module 11 (FIG. 2).

A lead set hanger 51 is provided to facilitate hanging of the terminal block 50 from the hood of the automobile being tested. The hanger 51 attaches around the terminal block lead portion 13*e* and the terminal block shield ground lead 13*d*, and can be moved for the most convenient height adjustment.

PROCESSING CIRCUIT

Referring to FIG. 11, the processing circuit 79 includes an input circuit 80, a waveform selection circuit 81, a polarity detection circuit 82, a cylinder interrupt generating circuit 83, a characterization circuit 84, a microprocessor 85 and a primary sync generating circuit 86.

The interface module 11 is adaptable to internal combustion engines having virtually any type of waste spark distributorless ignition system. The interface module 11 determines the number of cylinders of the engine under test, the polarity of the secondary waveform signals for each cylinder and characterizes the engine, providing the sequence of TRUE and WASTED firings for each cylinder. The microprocessor 85 operating under software control obtains this information and uses the information thus obtained to separate the secondary waveform patterns for the TRUE firings from the secondary waveform patterns for the WASTED firings and to invert the secondary waveform signals when required to provide a parade of secondary signals for the TRUE firings or the secondary signals for the WASTED firings as a function of the setting of the selector switch 42.

In the center position shown for selector switch 42 (as viewed in FIG. 7), switch section 42*a* enables the microprocessor mode select input to be at logic high level, enabling a TRUE waveform pattern display; switch section 42 extends the primary sync signal to the lead 27; and switch section 42*c* extends the signal on the alternator/volt lead 24 to output lead 28. In the right-hand position, switch section 42*a* connects ground to the microprocessor mode select input, enabling a WASTED waveform pattern display; switch section 42*b* extends the primary sync signal to output lead 27; and switch section 42*c* extends lead 24 to lead 28. In the left-hand position (as viewed in FIG. 7) switch section 42*a* enables fuel injection mode, shutting off the TRUE/WASTED display output; the switch section 42*b* connects the fuel injector signals input on lead 24 to the primary output lead 27, and the switch section 42*c* disconnects lead 28 from the module 11.

The engine analog signals are supplied to the interface module 11 through the input circuit 80 which includes buffer amplifiers 87, 88 and differential amplifier 89. The buffer amplifiers 87 and 88 are connected to the red coded lead 21 and white coded lead 22, respectively. The outputs of the buffer amplifiers are connected to inputs of the waveform selection circuit 81 and of the differential amplifier circuit 89, the output of which is the sum of the two signals conducted on the red coded lead 21 and white coded lead 22. The output of buffer amplifier 88 is also connected as the input to the characterization circuit 84.

The firing order for the cylinders of the engine under test is assumed to be 1-5-3-4-2-6. Cylinders 1 and 4 are companion cylinders. Cylinders 5 and 2 are companion cylinders. Cylinders 3 and 6 are companion cylinders. It is known that the signals produced in firing companion cylinders are complimentary (See FIG. 6, lines A and B). Thus, the engine under test can be characterized by processing the signals produced for the firing of half of the cylinders, cylinders 2, 4 and 6, in the present example, if the number of cylinders that the engine has is known. Alternatively, the engine under test can be characterized by processing the signals produced by each cylinder.

The number of cylinders is determined by counting the number of secondary waveform signals generated between successive number one interrupts. The number one interrupt signals are detected by an inductive hybrid circuit 90 of the cylinder interrupt generating circuit 83 the input of which is connected to the spark plug wire for the first cylinder in the engine firing pattern. The output of the cylinder interrupt generating circuit is an interrupt signal for the microprocessor 85, the time of occurrence of which defines the cylinder cycle time. The number of cylinder firings occurring during a given engine cycle is determined by counting the number of secondary waveform signals generated. This function is carried out by another portion of the cylinder interrupt generating circuit 83 which includes absolute value circuit 95 and a cylinder sync generator 96. The cylinder sync generator 96 generates an interrupt for the microprocessor each time a secondary waveform pattern is detected. The signal supplied to the input of the absolute value circuit 95 is the magnitude of the signals provided over the red coded input lead 21 and white coded input lead 22 as produced by the differential circuit amplifier 89.

The polarity of each secondary waveform signal is determined by the polarity detect circuit 82. This information is used in characterizing the engine.

The characterization circuit 84 includes an inverter 98, a polarity select switch 99, a fast peak and hold circuit 100, a peak and hold select circuit 101, slow peak and hold circuit 102, slow peak and hold circuit 103 and a peak compare circuit 104.

The engine is characterized using the secondary waveform signals input on only one of the input leads 21 and 22, the white coded lead 22 in the present example.

Because the peak and hold circuit 100 can only process positive going signals, the inverter 98 and associated invert/non-invert select switch 99 operate to apply only positive polarity signals to the input of the fast peak and hold circuit 100. Positive polarity signals present on the white coded lead 22 are extended directly to the input of the fast peak and hold circuit 100, and negative polarity signals present on the white coded lead 22 are passed through inverter 98 before application to the fast peak and hold circuit 100. The select switch 99 is controlled by the microprocessor 85 to extend the waveform signals on the white coded lead 22 directly or through inverter 98 to the fast peak and hold circuit 100. The determination as to the polarity of the each secondary signal is made by the polarity detect circuit 82 for each cylinder firing and this polarity information is retained by the microprocessor.

The fast peak and hold circuit 100 captures the KV peak value of the secondary waveform signals applied thereto. The characterizing circuit characterizes companion cylinders, such as cylinders 1 and 4, during a first engine cycle, and then characterizes the next pair of companion cylinders in the firing order such as cylinders 5 and 2, during the next cycle etc. As indicated, only the signals generated for the firing of the three cylinders are needed to characterize the engine. Also, the signals on the white coded lead 22 are used. Thus, the secondary waveform signal for the first firing of the first cylinder in the firing order namely, cylinder 1, which is passed to the slow peak and hold circuit 102 by the peak/hold select circuit 101 is that for the wasted firing of cylinder 4. The secondary waveform signal which is passed to the slow peak and hold circuit 103 is that for the true firing of cylinder 4, which occurs for the next firing of cylinder 1. The microprocessor 85 controls the peak/hold select switch 101 to select to which peak and hold circuit 102 or 103 the secondary waveform is extended. The signal outputs of the slow peak and hold circuits 102 and 103 are compared by the peak compare circuit 104. Because the peak value for a true firing (typically 6 KV to 14 KV) is substantially greater than the peak value for a wasted firing (typically 1 KV to 2 KV), the signal output of the peak compare circuit 104, together with the known cylinder polarity determined by circuit 82, enables determination of where in the cylinder firing sequence for cylinder 1 (and its companion cylinder 4) the true firing and wasted firing occur.

The information obtained by the polarity detect circuit 82, the cylinder sync generator 96 and the characterization circuit 84 enables the microprocessor 85 to control the waveform selection circuit 81 to output a parade of secondary pattern signals consisting of only TRUE firing signals or WASTED firing signals all of the same polarity or sense as a function of the setting of selector switch 42. Selector switch 42 is illustrated in FIG. 11 as having three sections **42*a*–42*c***, each comprising a three position switch, operated to the center position (FIG. 7) to select TRUE firing waveforms.

The waveform selection circuit 81 includes a red/-white select circuit 91, an invert/non-invert select circuit 92 and an output select circuit 93. The incoming secondary waveform signals are extended to the waveform select circuit which is operated under the control of the microprocessor 85 to select either the TRUE or WASTED patterns for transmission to the engine analyzer 18 (FIG. 2).

The select circuit 91 is controlled by the microprocessor 85 to extend either the secondary patterns for TRUE firings or the secondary patterns for WASTED firings in accordance with the setting of the selector switch 42. Select circuit 92 is controlled by the microprocessor 85 to pass negative polarity signals and inverts positive polarity signals provided at the output of inverter **92*a* such that the signal pattern passed to the engine analyzer includes signals of the correct polarity. That is, the parade pattern passed to the engine analyzer consists of negative polarity signals because the engine analyzer required negative polarity input to provide a positive waveform display. The output select circuit 93 is controlled by the microprocessor 85 to extend a ground level output through buffer amplifier 93*a* to lead 25 which is connected to the engine analyzer 18 (FIG. 2), forcing a straight line display on the screen of the engine analyzer during the time the first characterization of the incoming signals is being carried out and to enable the secondary pattern parade to be passed to the engine analyzer over conductor 25** after the initial characterization is completed. During the fuel injection mode, the secondary waveform output to the engine analyzer is terminated.

The interface module 11 generates a primary sync signal for application to the engine analyzer 18. The output of the cylinder sync generator 96 is NOR'd by gate **86*a* with an output of the microprocessor 85 for enabling primary sync generator 86 to generate a primary sync signal for the engine analyzer 18. Because the primary sync signal is derived from the secondary waveform signals which are characterized by ringing and other disturbances, the microprocessor controls when the NOR gate 86a is enabled to insure that the primary sync signal is generated at the proper time so as to avoid mistriggering of the engine analyzer. The primary sync signal is a 200 volt signal which is applied via lead 27 to the appropriate input of the digital engine analyzer 18**.

In distributorless ignition systems, two number one sync pulses are generated for each engine cycle, one for the TRUE firing of cylinder, and one for the WASTED firing of cylinder 1. Accordingly, because the engine analyzer sequencing is dependent upon receiving a single number one output per engine cycle, the microprocessor 85 divides by two the number of number one signals generated and applies them to the engine analyzer 18 (FIG. 2) via lead 26 at the proper time in the secondary waveform parade.

The primary sync generator 86 also includes a monitoring circuit which monitors the amplitude of the primary sync pulse generated by the interface module 11. If this signal decreases below a preset threshold value, such as 140 volts, the module inhibits the secondary output the engine analyzer because the loss of sync when the primary sync signal decreases below the threshold value will cause the engine analyzer to seek the secondary waveform as an alternative sync resulting in display of unwanted signals on the screen of the engine analyzer. This function could occur if the operator enables the engine analyzer 18 to operate in the cylinder shorting mode.

SOFTWARE

Figure 16:
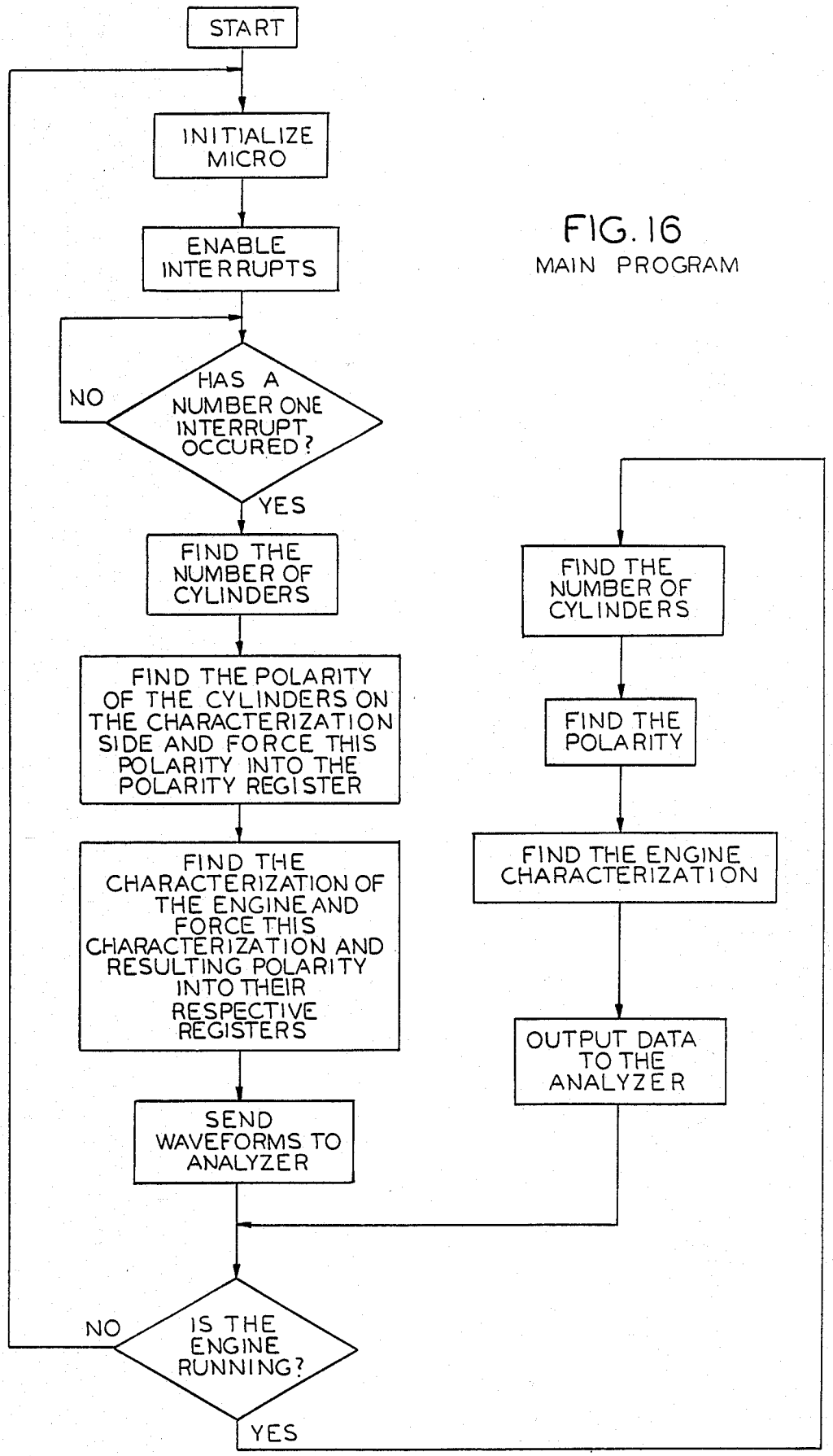
FIG. 16 is a process flow chart illustrating operation of the interface module.

The software for controlling the operation of the microprocessor includes a main program and four interrupt routines. A process flow chart for the main program is illustrated in FIG. 16. The interrupt routines include a number one interrupt routine, FIG. 17, a cylinder interrupt routine, FIGS. 18 and 18A, a timer interrupt routine, FIG. 19, and a timer switch interrupt routine, FIG. 20.

Figure 21:
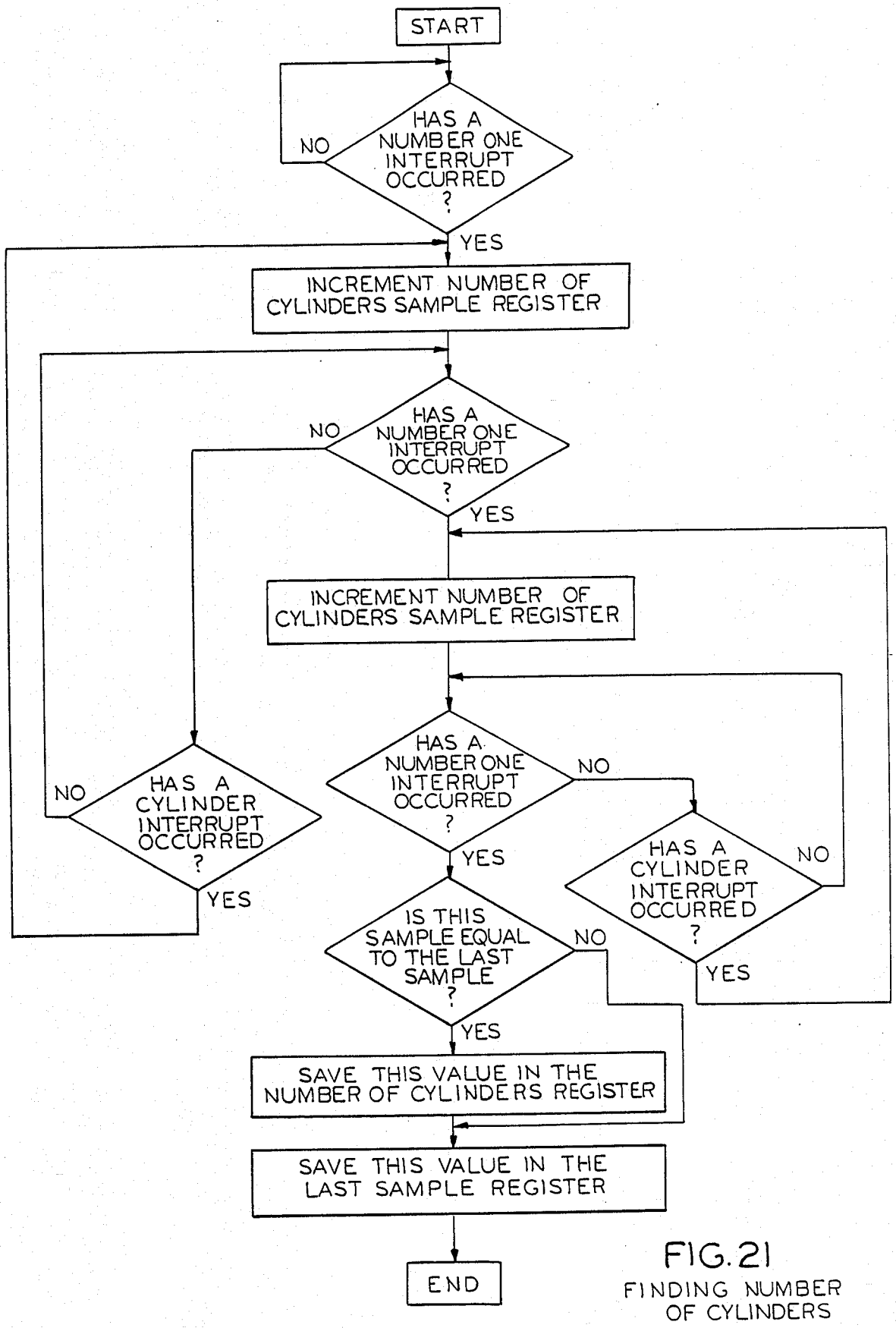
FIG. 21 is a process flow chart illustrating steps in determining the number of cylinders of the engine.
Figure 22:
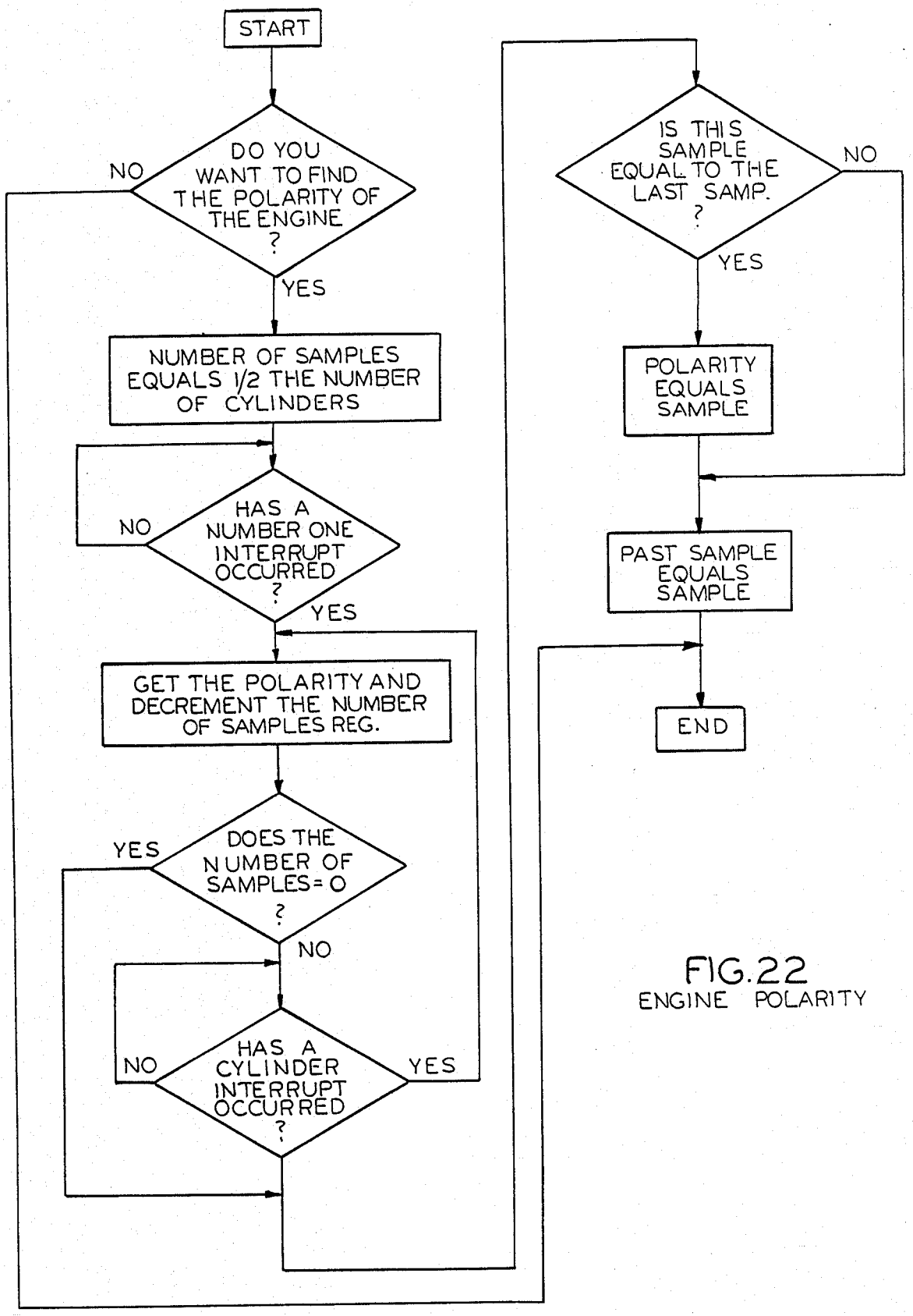
FIG. 22 is a process flow chart illustrating steps in determining the polarity of the engine.
Figure 23:
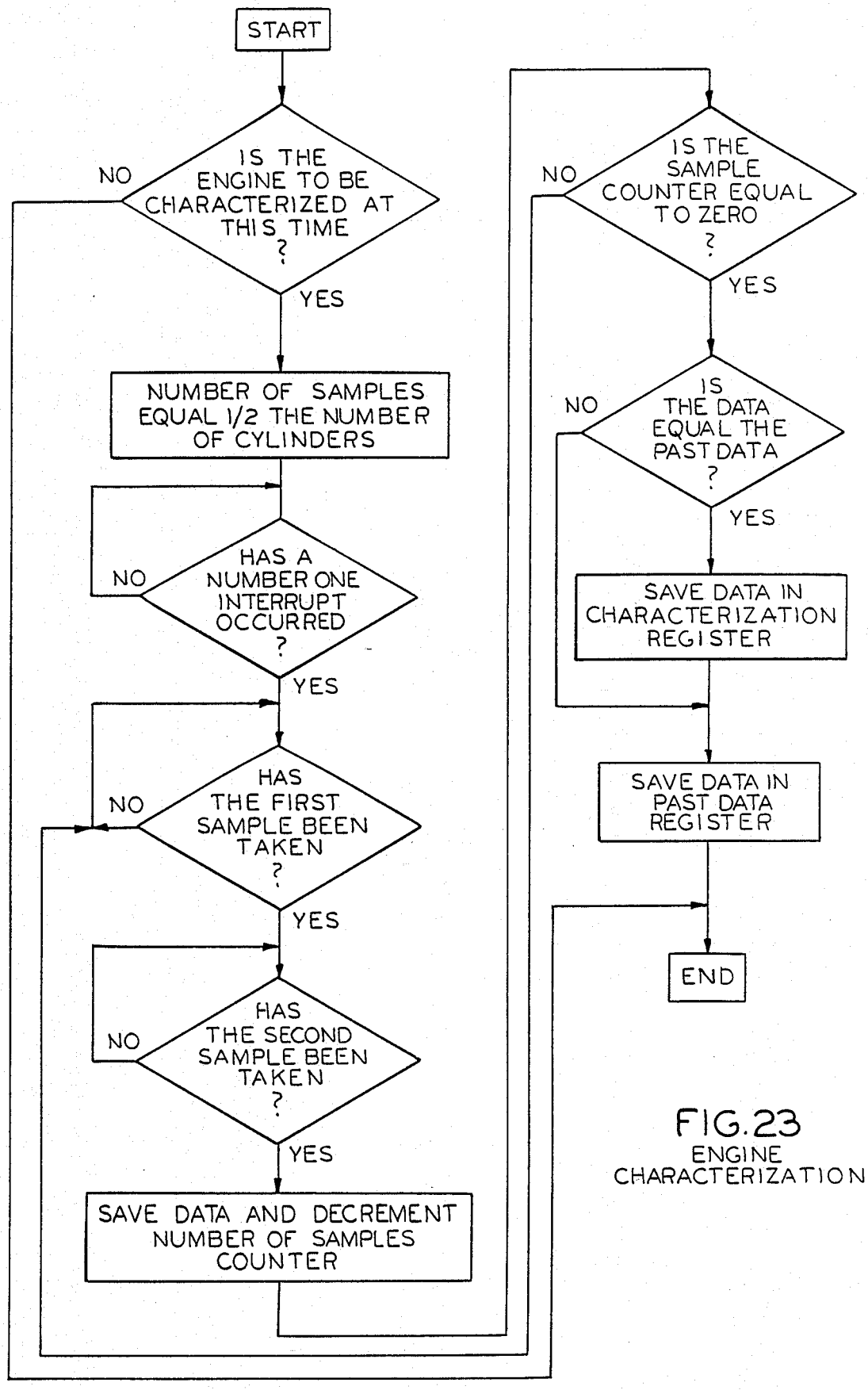
FIG. 23 is a process flow chart illustrating steps in characterizing the engine.

The main routine determines the order in which the steps required in characterizing the engine are carried out. The main program initiates the process of determining the number of cylinders of the engine under test, the polarity of the engine and the characterization of the engine. More detailed process flow charts for portions of the main program are illustrated in FIGS. 21–23. FIG. 21 is a process flow chart illustrating steps in determining the number of cylinders of the engine. FIG. 22 is a process flow chart illustrating process steps in determining the polarity of the engine. FIG. 23 is a process flow chart illustrating steps in the process of characterizing the engine.

Figure 17:
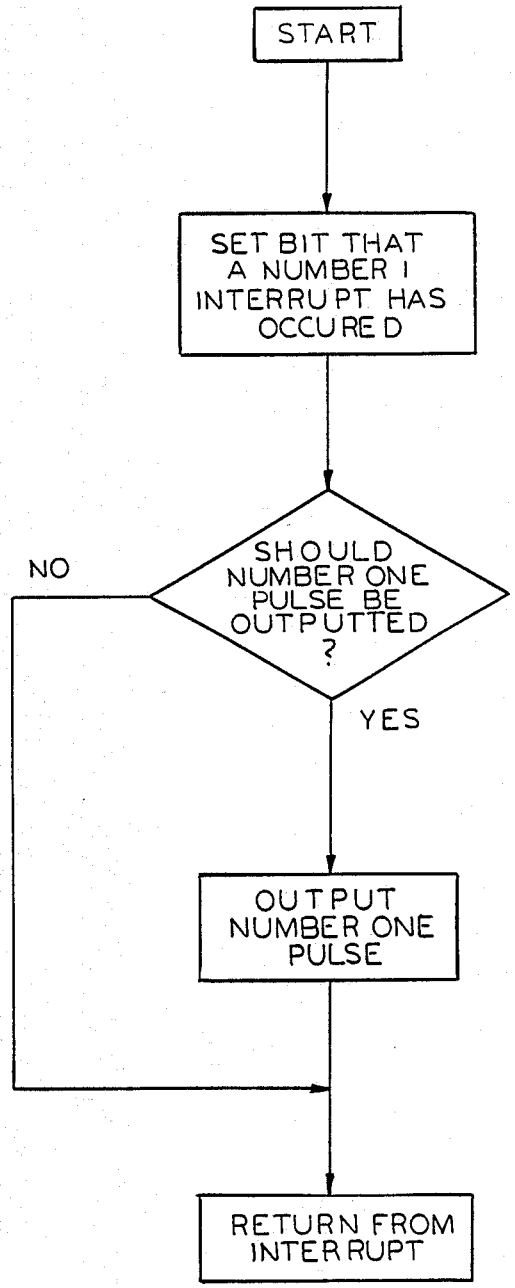
FIG. 17 is a process flow chart for the number one interrupt routine.

Referring to FIG. 17, the number one interrupt routine determines when a number one output pulse should be extended to the engine analyzer 18 (FIG. 2) and notifies the cylinder interrupt routine (FIGS. 18 and 18A) whenever a number one interrupt occurs. The number one interrupt routines has a higher priority than the other interrupt routines.

Figure 18:
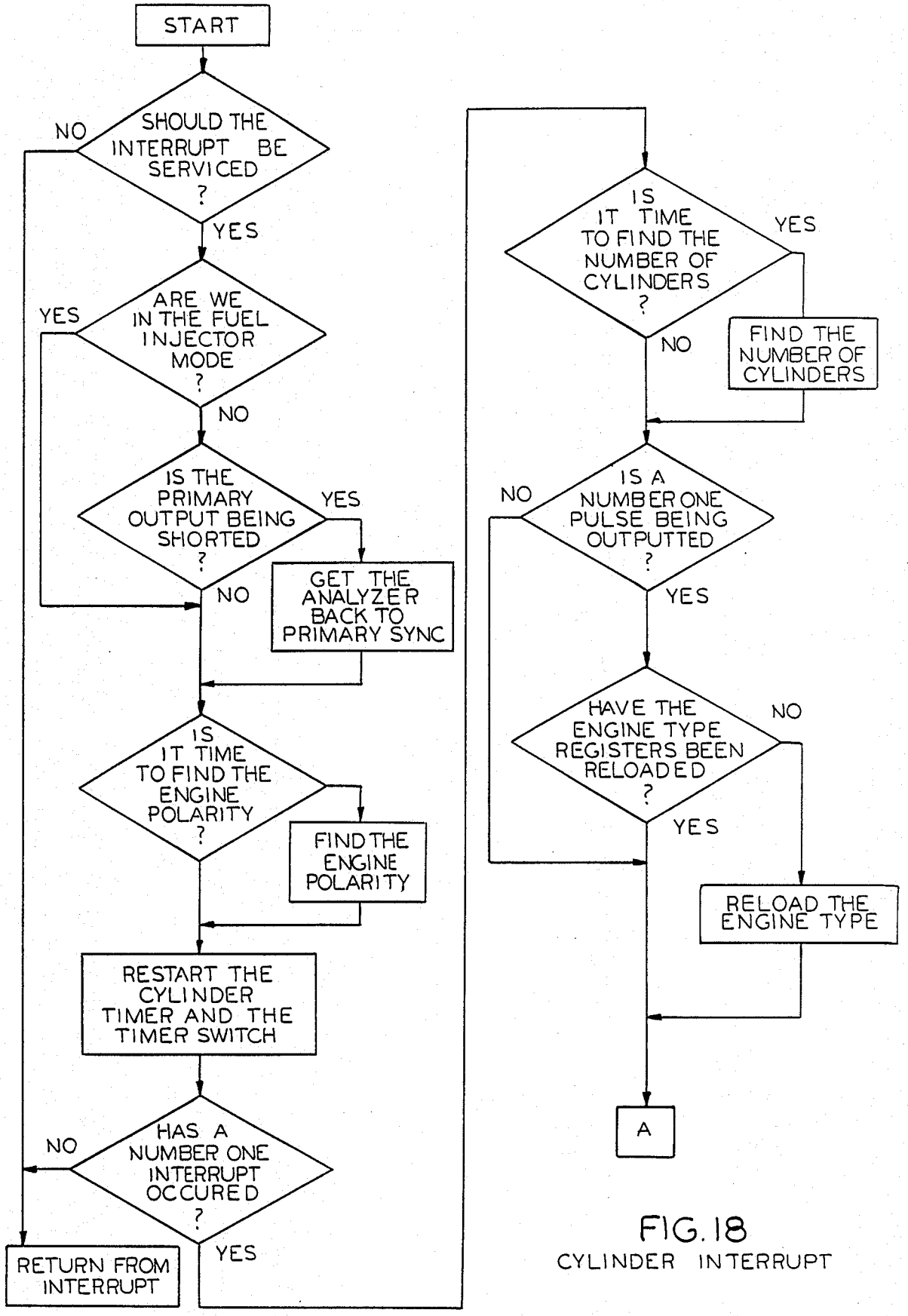
FIGS. 18 and 18A is a process flow chart for the cylinder interrupt routine.
Figure 18A:
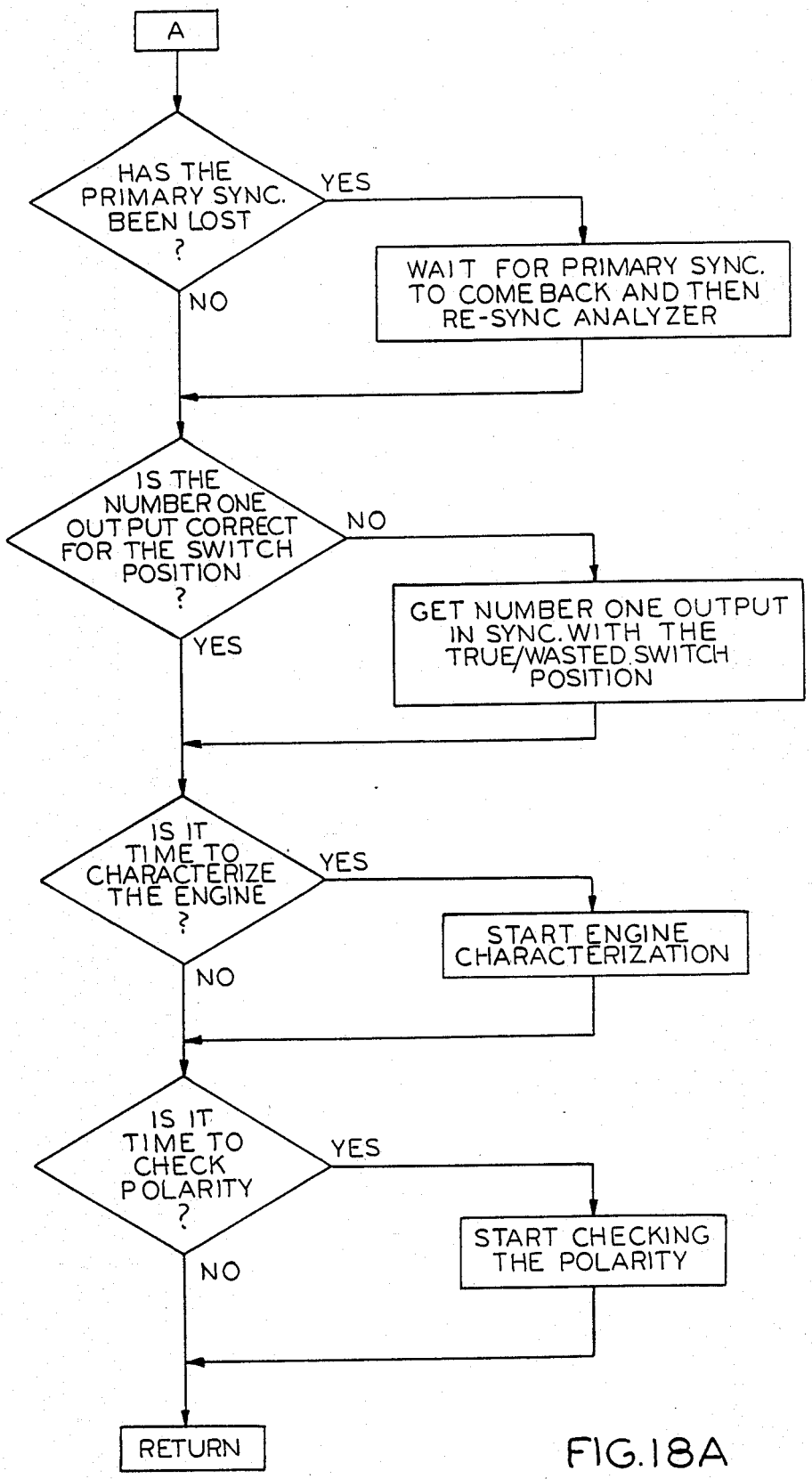

Referring to FIGS. 18 and 18A, the cylinder interrupt routine causes the polarity detect circuit to determine the polarity of the incoming secondary waveform signal at the leading edge thereof, extends the cylinder sync signal to the engine analyzer 18 (FIG. 2), counts the number of cylinders based upon secondary waveform signals indicative of cylinder firings and controls the reset of a cylinder timer which determines the time periods between successive firings. It also determines the time period (from the cylinder timer) for the timer switch and starts it.

Figure 19:
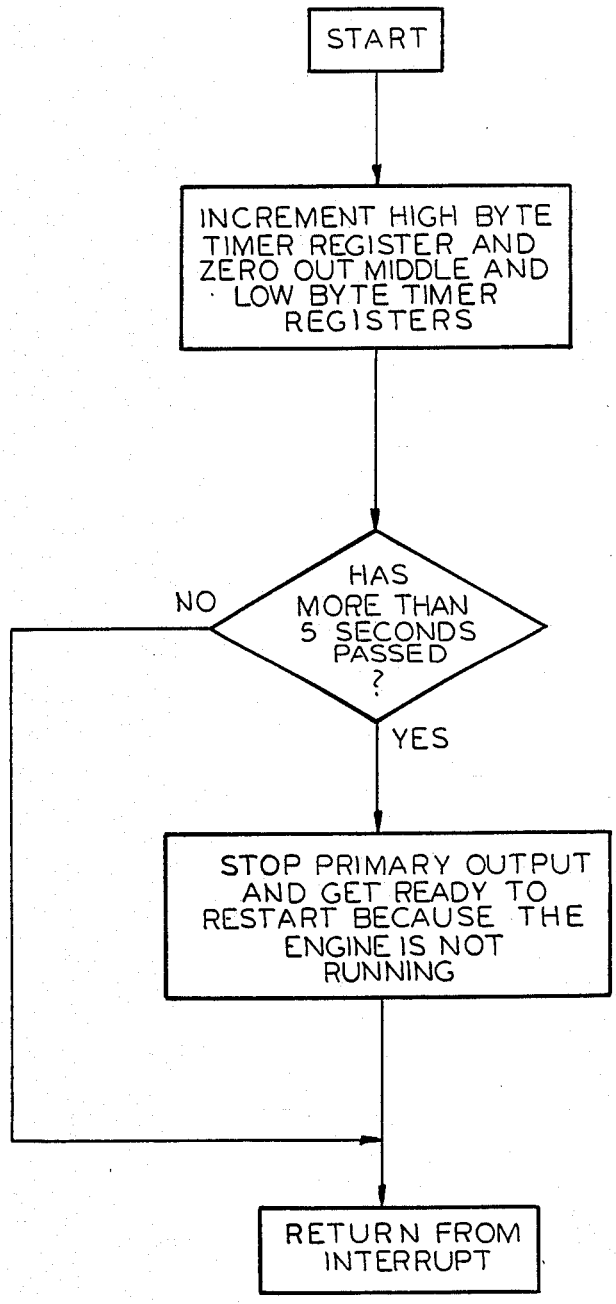
FIG. 19 is a process flow chart for the timer interrupt routine.

FIG. 19 is the timer interrupt routine which times the interval between successive firings, a timer being reset for each firing. Thus, failure of the timer to be reset within a predetermined time, for example 5 seconds, is indicative that the engine under test is not running.

Figure 20:
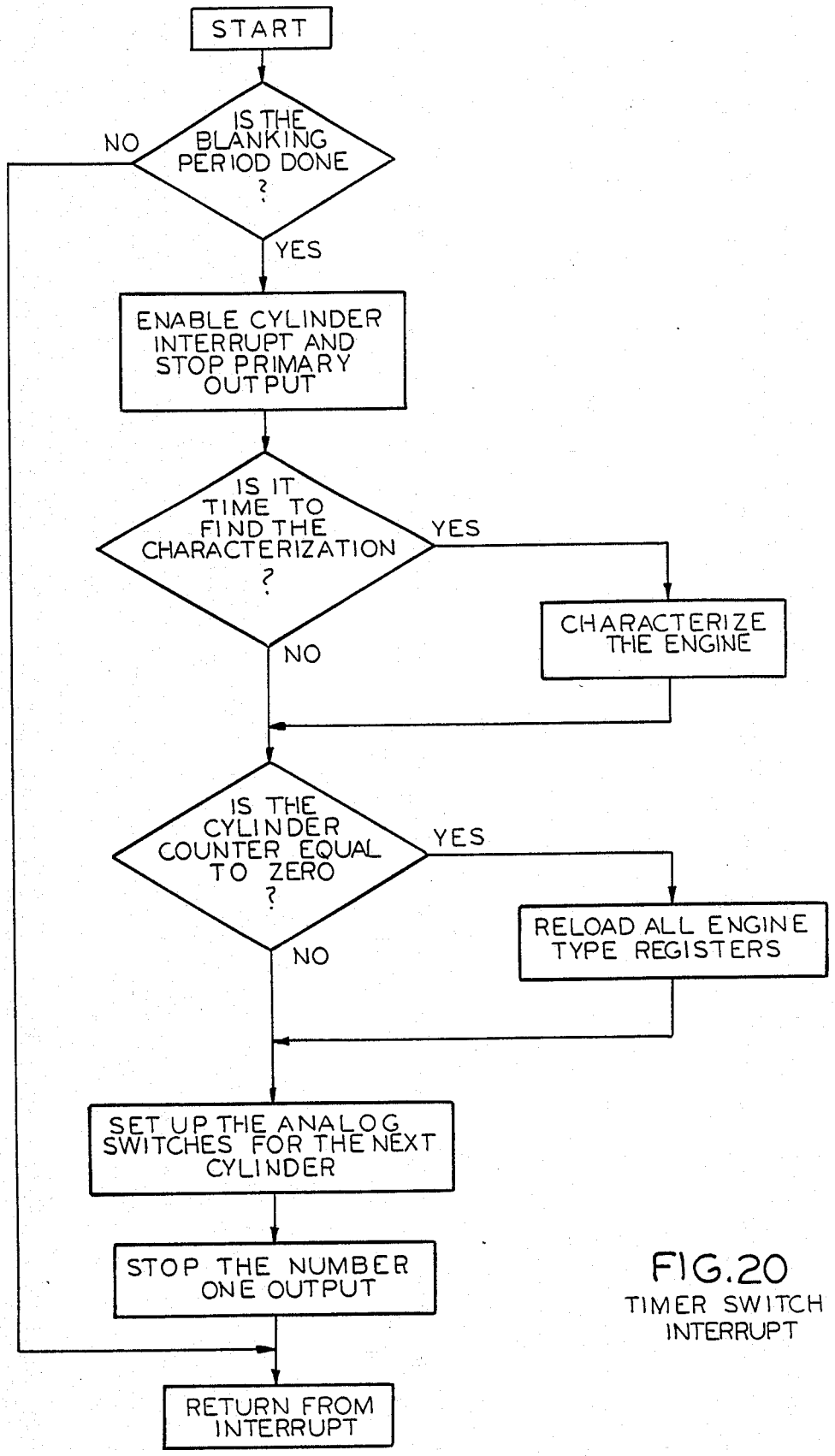
FIG. 20 is process flow chart for the timer switch interrupt routine.

Referring to FIG. 20, a timer switch interrupt routine enables the primary output and number one sync output to the engine analyzer 18 (FIG. 2). The timer switch interrupt routine also provides a blanking period for the cylinder interrupt routine, controls the operation of all of the analog switches of the processing circuit, and carries out characterization of the engine.

Referring to FIG. 16, which is a process flow chart for the main program which determines the order in which operations are carried out, after initialization and enabling the interrupts, the program looks for a number one interrupt to determine the start of an engine cycle and when the first number one interrupt is detected, the program initiates the process of determining the number of cylinders.

FIG. 23 is a process flow chart representative of the operations performed in determining the number of cylinders. The main program and the cylinder interrupt routine are involved in these operations. In response to the first number one interrupt, the program increments a number of cylinders sample register and then detects the number of interrupts that occur prior to occurrence of the next or second number one interrupt, i.e., the number one interrupt which occurs at the beginning of the next engine revolution, this number one interrupt occurring in the middle of the engine cycle. When this next number one interrupt occurs, the program counts the number of cylinder firings occurring during the last half of the engine cycle, and when the third number one interrupt in the series occurs, the number one interrupt generated at the start of the next engine cycle. For the initial processing cycle, the engine data (representing the number of cylinders) obtained is "forced" into the number of cylinders register. In subsequent processing cycles, the program compares the sample last obtained with the sample previously obtained, and if the two samples are equal, the information is loaded into the number of cylinders register. If not, the information is loaded into the last sample register and the process is repeated the next time a number one interrupt is generated.

Referring again to FIG. 16, after the number of cylinders has been determined in the first engine cycle, then the polarity of the cylinders is determined. The process flow chart illustrated in FIG. 22 is representative of the operations performed in determining the polarity of the engine. The main program and the cylinder interrupt routine are involved in these operations. As indicated hereinabove, in the example, the secondary signals generated as the result of firing of only half of the cylinders are used in characterizing the engine and accordingly the number of samples taken is specified as being equal to one-half the number of cylinders. When the next number one interrupt occurs, the polarity of the waveform signal is determined and a sample counter is decremented each time a cylinder interrupt occurs until three cylinder interrupts have occurred. The initial value is forced into the engine data register. In subsequent processing cycles, the program compares the polarity of the current sample with the last obtained sample and if the polarity is the same, the information is saved. Otherwise the information is loaded into the sample register for comparison with the next sample obtained.

Returning again to FIG. 16, once the engine polarity has been determined, characterization of the engine is carried out. FIG. 23 is a process flow chart representative of the operations performed in characterizing the engine. As for the polarity detection process, the number of samples is equal to one-half the number of cylinders and the program is initiated with the occurrence of the first interrupt. For each cylinder, samples are taken for successive firings by the slow peak/hold circuits 102 and 103 (FIG. 11) and held for comparison by the peak compare circuit 104 (FIG. 11). After the samples have been taken and held, for a given cylinder, a sample counter is decremented and the process is repeated for the two remaining cylinders. When the characterization data has been obtained, a test is made to determine if the data has changed, and if not, it is saved in the characterization register and the past data register. If is changed, it is only saved in the past data register for comparison with the results of the subsequent characterization operation.

Referring again to FIG. 16, when characterization is completed, the microprocessor controls the waveform select circuit 81 (FIG. 11) to pass the appropriate secondary waveform signals to the engine analyzer 18 (FIG. 2). The program then reads a cylinder timer to determine if the engine is running and if so, begins an update cycle in which the number of cylinders is determined, the engine polarity is determined, and the engine characterization is determined and compared with the data previously obtained for each cycle. If the engine is not running, as indicated by the cylinder counter, the program returns to the start of the main program to re-initialize the processor.

A process flow chart for the number one interrupt routine is illustrated in FIG. 17. Each time a number one interrupt is generated by the inductive hybrid circuit 90 (FIG. 11), the processor sets a bit indicating that a number one interrupt has occurred. The interrupt routine then determines if a number one pulse should be outputted to the engine analyzer 18 (FIG. 2), and if so, generates a number one output pulse on lead 26 (FIG. 11). If not, the main program is reentered.

Referring to FIGS. 18 and 18A, which illustrate the process flow chart for the cylinder interrupt routine, the interrupt routine first determines if the interrupt should be serviced and if so, checks to determine if the interface module is operating in the FUEL INJECTION MODE and if not determines if the primary output is shorted. By determining the status of the primary sync generator circuit 86 and if so synchronizes the engine analyzer 18 to the primary sync. Then the interrupt routine checks to see if it is time to determine the engine polarity, and if so, determines the engine polarity. If not, the cylinder timer and timer switch are restarted and the interrupt routine then checks to determine if a number one interrupt has occurred. If not, the program returns from the interrupt routine. If a number one interrupt has occurred, the interrupt routine determines if it is time to determine the number of cylinders and, if so, the number of cylinders is determined. The interrupt routine then determines if a number one sync pulse is being generated, and if so, determines if the engine type register has been reloaded. If not, the engine register is reloaded and the program then checks to see if the primary sync has been lost. If so, the program waits for a primary sync to be generated and for the engine analyzer 18 to be resynced. The interrupt routine then determines if the number one output is correct for the switch position and if not, synchronized the number output with the switch position. The interrupt routine then determines if its time to characterize the engine, and if so, engine characterization operations are carried out. The program then determines if its time to check the engine polarity, and if so, the engine polarity is checked. The interrupt routine then returns to the main program. The foregoing descriptions represent the general flow of the cylinder interrupt routine. However, the task at hand may require a number of engine revolutions and a number of interrupts before the task is completed.

FIG. 19 illustrates the process flow chart for the timer interrupt routine. This routine increments a counter which is reset by each cylinder interrupt. If the counter reaches a count corresponding to a preselected time, such as 5 seconds, it is assumed that the engine under test is not running and the interrupt program stops the primary output and signals the main program to restart the software.

Referring to FIG. 20, there is illustrated the process flow chart for the timer switch interrupt routine. The main function of this routine is to set all of the analog switches to insure that the processing circuits are conditioned for detecting the leading edge of the secondary waveform signals in time. This routine obtains the time between cylinder firings obtained by the timer interrupt routine, and divides this time in two, locating the time midway between successive firings. At this time, the processing circuits are enabled prior to the time of occurrence of the leading edge of the secondary signals for detecting polarity of the secondary signals and their peak value. If it is time to characterize the engine, and if so, this routine will carry out the characterization. A check is made to determine if the cylinder counter is zero and if so, the engine registers are reloaded and the analog switches are set for the next cylinder. The interrupt routine then terminates the number one output. The foregoing descriptions represent the general flow of the timer switch interrupt routine. However, the task at hand may require a number of engine revolutions and a number of interrupts before the task is completed.

OPERATION

Referring to FIGS. 6 and 11 and the process flow chart for the main program illustrated in FIG. 16, for purposes of illustration of the operation of the interface module, it is assumed that the cylinder firing order is 1-5-3-4-2-6and that selector switch 42 is set to select TRUE firing waveforms for application to the engine analyzer 18 (FIG. 2).

The secondary waveform signals extended to the interface module 11 over the red coded input lead 21 are assumed to be as illustrated in FIG. 6, line A and the secondary waveform signals extended to the module over the white coded input lead 22 are illustrated in FIG. 6, line B.

After initialization, the first step in the process is to determine the number of cylinders. The number one sync signal generated by the engine at the start of each engine cycle is detected by the inductive hybrid circuit 90 which responsively provides an interrupt to the microprocessor 85 to initiate the characterization process.

During the time that the initial characterization of the engine is being carried out, the microprocessor 85 operates under program control to cause the output select circuit 93 to ground the secondary signal output to the engine analyzer 18 (FIG. 2) such that a straight line display is provided on the screen 18*a* of the engine analyzer.

Referring to FIGS. 6, 11, 16, 21 and 22, during the first engine cycle, the number of cylinders is determined by detecting each cylinder firing and counting the number of secondary waveform signals produced. The first TRUE pulse, FIG. 6, line A, and the first WASTED pulse, FIG. 6, line B, for cylinder 1 and its companion cylinder 4, respectively, are applied to the differential amplifier circuit 89 which provides a signal output corresponding to the magnitude of the TRUE and WASTED firing signals. The resultant signal is applied to the polarity detect circuit 82 and to the absolute value circuit 95. Signal outputs corresponding to the sum of the TRUE and WASTED firing signals are produced in response to the firing of the other four cylinders in the firing order.

After the number of cylinders has been determined, the polarity detect circuit 82 detects the polarity of the incoming signal output from the differential amplifier circuit 89 and provides an input to the microprocessor 85 indicative of the polarity of the secondary waveform signal generated in response to firing of the number one cylinder, and thus, the polarity of the firing of the number one cylinder which is the first cylinder in the firing sequence.

The absolute value circuit 95 provides a positive going signal to the cylinder sync generator circuit 96 regardless of the polarity of the signal output of the differential amplifier for each cylinder firing. The cylinder sync generator responsively generates an interrupt for the microprocessor.

The microprocessor 85 counts the number of cylinder sync pulses generated to determine the number of cylinders for the engine under test. The microprocessor 85 also receives and stores the information provided by polarity detect circuit 82 as to the polarity of the secondary waveform signal for each cylinder for each engine cycle.

The primary sync generator responds to each cylinder interrupt supplied thereto by NOR gate 86*a* when enabled by the microprocessor 85 to output a 200 volt sync pulse to the digital engine analyzer on output lead 27.

Referring to FIGS. 6, 11, 16 and 23, after the number of cylinders and the engine polarity have been determined, the characterization of the engine is carried out to determine the location of the true and wasted firings for the cylinders in the secondary waveform parade.

As has been indicated in the present example, the engine characterization is carried out using only the secondary pattern appearing on the white coded input lead 22. As shown in FIG. 6, line B, the first pulse is a negative going WASTED pulse. Accordingly, the microprocessor 85 will control the select switch 99 to extend the output of inverter 98 to the fast peak and hold circuit 100. The fast peak and hold circuit 100 will capture the leading edge of the secondary signal. The microprocessor 85 then operates the peak/hold select circuit 101 to extend the output of the fast peak and hold circuit 100 to the slow peak/hold circuit 102 which holds the sample until reset by the microprocessor 85.

The microprocessor 85 then waits for the next firing of the number one cylinder, at which time the companion cylinder 4, provides a negative going TRUE firing signal (FIG. 6, line B). The negative going signal is extended through inverter 98, the microprocessor 85 controlling select switch 99 to extend the output of inverter 98 to the fast peak and hold circuit 100 which will capture the KV peak value. The microprocessor 85 operates the peak/hold select circuit 101 to extend the output of the fast peak and hold circuit to the slow peak/hold circuit 103. The two signals now held by the two peak/hold circuits 102 and 103, correspond to the peak values for the two firings of cylinder 4 during a given engine cycle. These signals are compared by the peak compare circuit 104. In the present example, wherein the second value received which corresponds to a TRUE firing, is greater than the first value which corresponds to a WASTED firing, the signal output of the peak compare circuit 104 will be logic ground, providing an indication to the microprocessor 85 that the second signal is larger than the first signal and thus the second signal is the TRUE firing while the first signal is the WASTED firing. Because the secondary waveform signals produced by companion cylinders are complementary, the information obtained in processing the secondary waveforms for cylinder 4 provides the polarity and the sequence of TRUE and WASTED firings for cylinder 1.

The remaining cylinder pairs 5-2 and 3-6 are characterized in the same manner. The resultant information is stored by the microprocessor 85 and is used in controlling the waveform selection circuit 81 to output the proper parade pattern of secondary signals. In the present example wherein the selector switch 42 is set to output the TRUE pattern, the microprocessor 85 reads the condition of switch 42 and controls select circuit 91 to alternate in correspondence with the input parade pattern shown in FIG. 6, lines A and B to alternately pass the TRUE firing waveforms to the output of the interface module 11. The microprocessor 85 controls the inverter select switch 92 to invert each of the signals representing TRUE firings conducted on the white coded lead 22, FIG. 6, line B.

The polarity obtained by the polarity detect circuit 82 is used in determining the engine characterization. In the example, (FIG. 6, line A) the polarity of the first three cylinders is positive, positive, positive or represented in binary code 111. The first polarity determination equals the second polarity determination 111=111, or 111111.

This output controls the sample polarity select 99. The engine characterization (FIG. 6, lines A, B) for firing sequence 1, 5, 3, 4, 2, 6 is 101010 where 1 and 0 represent true and wasted firings, respectively. This output controls the red/white select switch 91. The polarity 111111 is exclusive OR'D with the characterization 101010 and the result is 010101. The inverse of this 101010 is used to control the invert/non-invert select switch 92.

For characterization 101010, red/white switch will pass cylinder firing signals in the sequence 1-5-3-4-2-6 where firings 1, 3, 2 are positive waveforms for true firings and firings 5, 4, 6 are negative waveforms for true firings. The output 101010 causes invert/non-invert select switch 92 to invert the secondary waveforms, as required so that all the secondary waveforms extended to the engine analyzer are of the correct polarity.

For the first engine data obtained, the microprocessor 85 forces the engine characterization data, number of cylinders data and engine polarity date into engine data registers (not shown) of the microprocessor. The microprocessor 85 then enables the output select circuit 93 to release the ground level, and enable the secondary output parade pattern to pass to the digital engine analyzer 18 (FIG. 2) for display.

Thereafter, the microprocessor 85 operating under program control periodically checks to determine if there has been a change in the secondary waveform signals or the setting of the selector switch 42. After the initial engine data is obtained, the microprocessor operating under program control, requires that the latest engine data obtained be the same for two sample periods before the updated information is accepted and stored in the engine data registers.

The microprocessor 85 operating under program control times the duration between cylinder firings. If a preselected time interval elapses between successive cylinder firings, this is interpreted by the microprocessor 85 that the engine is not running. For such condition, the microprocessor 85 controls output select circuit 93 to provide a ground level on output lead 25.

If the operator operates the selector switch 42 to the right-hand position labelled WASTED, the microprocessor will control the waveform select circuit 81 to output the secondary waveform parade pattern for WASTED firings. If the selector switch 42 is operated to the left-hand position, the interface module 11 is conditioned for fuel injection mode operation, the primary sync pulse source being disconnected from output lead 27, and the fuel injector input signals being extended to the engine analyzer via output lead 27.

DETAILED DESCRIPTION OF CIRCUITS

Figure 15:
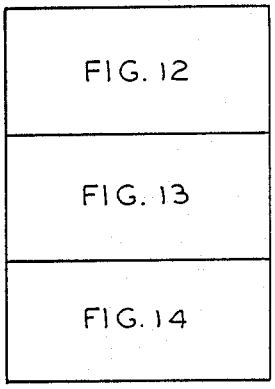
FIG. 15 illustrates how
Figure 12:
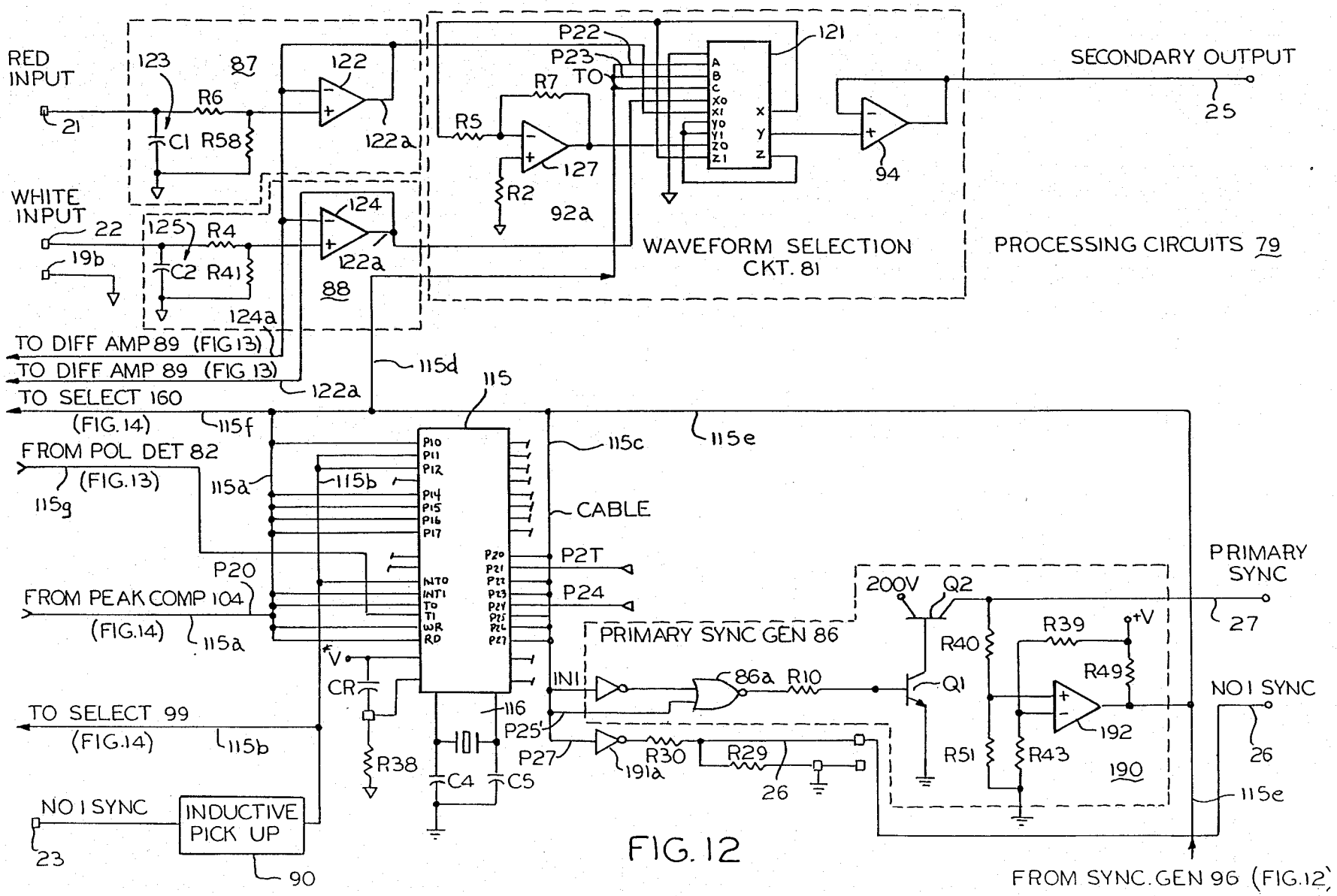
FIGS. 12, 13 and 14 when arranged as shown in FIG. 15, are a detailed schematic circuit diagram for the circuits of the interface module.
Figure 13:
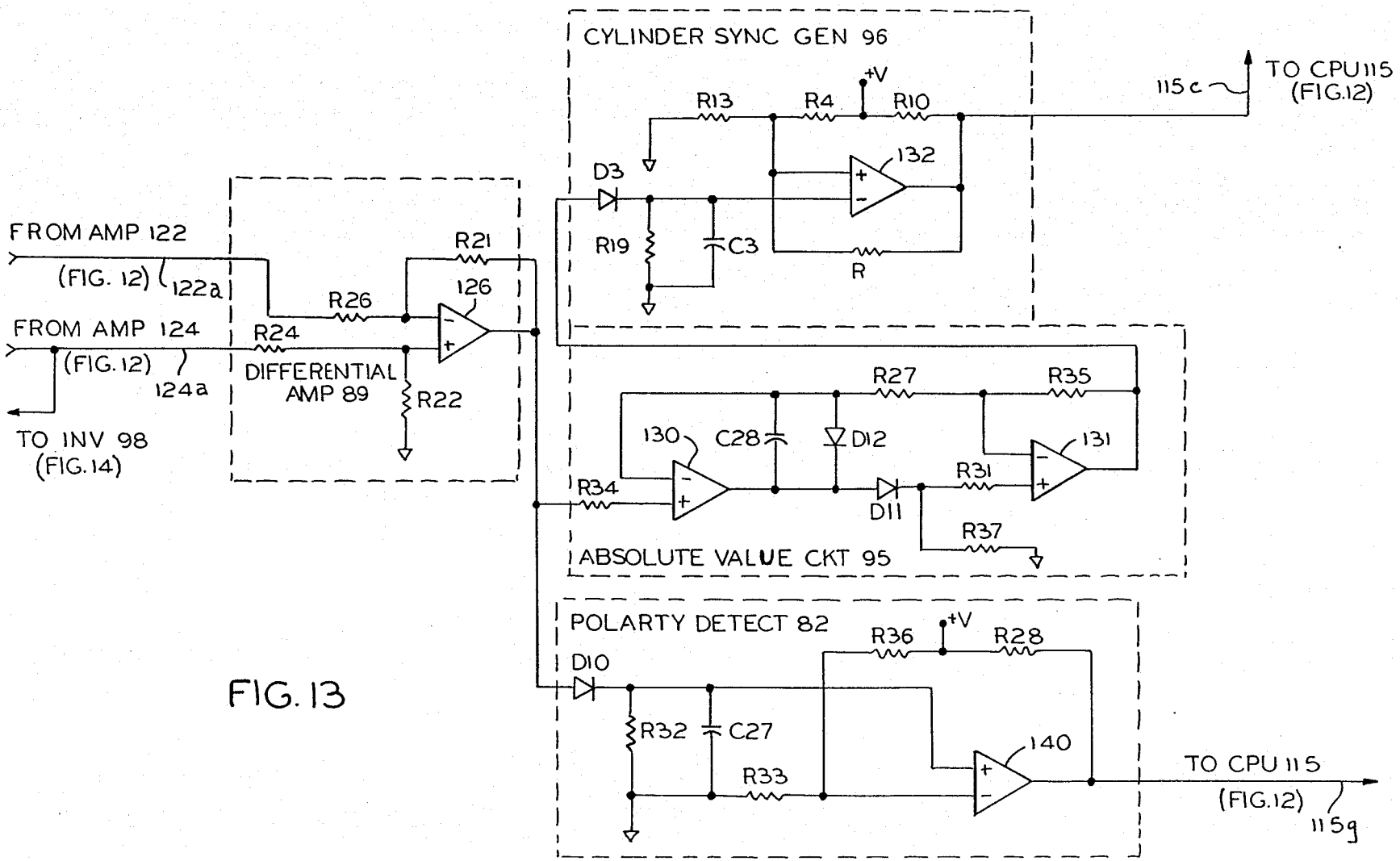
Figure 14:
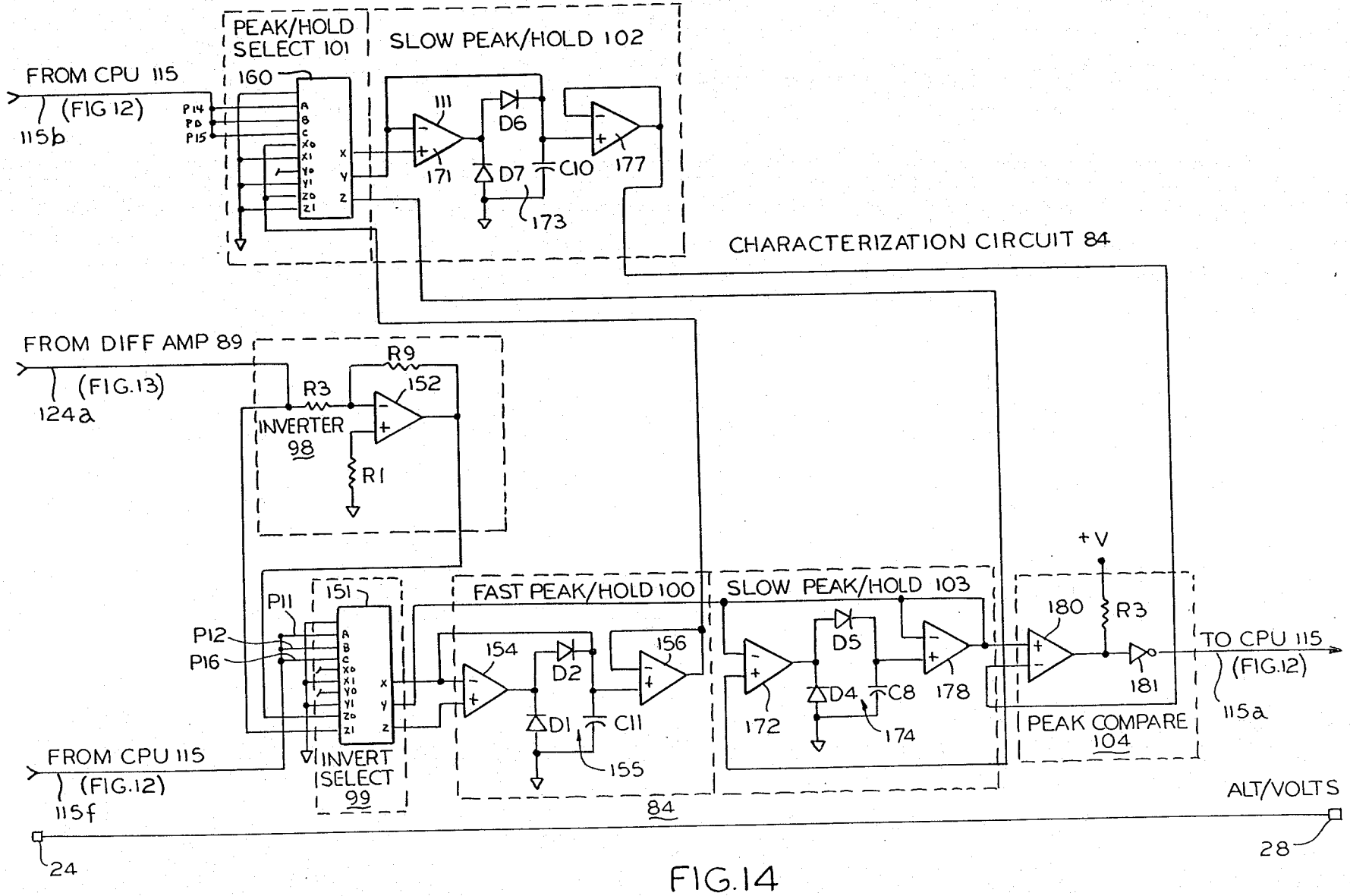

FIGS. 12–14, when arranged as shown in FIG. 15, provide a detailed schematic circuit and diagram of one realization for the electronic circuits 79 of the interface module 11.

Referring first to FIG. 12, the microprocessor 85 includes a central processing unit 115 having an associated clock pulse generating circuit 116 for generating synchronizing pulses for the central processing unit. The central processing unit has programmable input-/output ports 1-3 with port lines P10-P17, P20-P27, and P30-P37 with ports P3.2-P3.5 receiving interrupt inputs INT0, INT1, T0 and T1 on leads P32-P35.

The definition of the port lines for ports 1–3 is as follows:

Port 1
P1.0—reset peak/hold #1
P1.1—reset fast peak/hold
P1.2—reset peak/hold #2
P1.3—not used
P1.4—input peak/hold #1
P1.5—input peak/hold #2
P1.6—sample polarity select
P1.7—cylinder data write
Port 2
P2.0—peak compare input
P2.1—fuel switch
P2.2—positive/negative select
P2.3—signal output select
P2.4—true/wasted switch
P2.5—primary output
P2.6—cylinder shorting check
P2.7—#1 output
Port 3
P3.0—not used
P3.1—not used
P3.2—#1 interrupt
P3.3—cylinder interrupt
P3.4—waveform invert/non-invert select
P3.5—polarity detect input
P3.6—characterization write
P3.7—polarity write The waveform selection circuit 81 (FIG. 11) comprises an analog switch 121 which provides the function of select circuit 91, invert select circuit 92 and output select circuit 93. The analog switch has signal inputs 121-X0, 121-X1; 121-Y0, 121-Y1; and 121-Z0, 121-Z1. The analog switch has three select inputs 121-A, 121-B and 121-C which select the X, Y and Z inputs, respectively. The inputs 121-X0 and 121-X1 receive the positive firing secondary signals on red coded lead 21 and the negative firing secondary signals on white coded lead 22, respectively.

The analog switch has output 121-X, 121-Y and 121-Z. The output 121-X is connected to input 121-Z1 and through inverter circuit 92*a*, which includes operational amplifier 127 and resistors R2, R5 and R7, to input 121-Z0, serving as invert select circuit 92 (FIG. 11). Output 121-Z is connected to input 121-Y0, input 121-Y1 being connected to ground. Output 121-Y is connected through buffer amplifier 94 to the secondary output lead. The select inputs 121-A-C are connected through leads P22, P23 and T0 to respective port lines P2.2, P2.3 and P3.4 of the microprocessor 85.

Buffer amplifier 87 includes an operational amplifier 122 connected for operation as a unity gain amplifier having a filter network 123 connected to its non-inverting input. The output 122*a* of the amplifier 122 is connected through lead 122*a* to input 121-X1 of the analog switch 121. Similarly, buffer amplifier 88 comprises an operational amplifier 124 connected for operation as a unity gain amplifier and having a filter network 125 connected through lead 124 to its non-inverting input. The output of amplifier 124 is connected to input 121-X0 of the analog switch.

Referring to FIG. 13, the differential amplifier 89 includes an operational amplifier 126 having its non-inverting input connected through a resistor R24 to the output of the buffer amplifier 87 and its inverting input connected through resistor R26 to the output of buffer amplifier 88. A resistor R21 is connected between the output and the inverting input of amplifier 126 which has its non-inverting input connected to ground through a resistor R22. The output of the operational amplifier 126 is connected through a resistor R34 to an input of an operational amplifier 130 which together with operational amplifier 131 comprise the absolute value circuit 95.

The output of operational amplifier 130 is connected through diode D11 and resistor R31 to the non-inverting input of operational amplifier 131 which has its output connected through resistor R35 to its inverting input and through a resistor R27 to the inverting input of operational amplifier 130. A capacitor C28 and diode D12 are connected between the inverting input of operational amplifier 130 and the output of operational amplifier 130. The junction of diode D11 and resistor R31 is connected through a resistor R37 to ground. The output of operational amplifier 131 is also connected through a diode D3 to the inverting input of a comparator 132 which comprises the cylinder sync generator 96.

The capacitor C3 and resistor R19 are connected in parallel between the inverting input of the comparator 132 and ground. The non-inverting input of the comparator 132 is connected to a reference potential derived from series connected resistors R11 and R13 which are connected between +V and ground. The output of the comparator 132 is connected through resistor R10 to +V and through conductor INT1 to port P3.3 of the microprocessor central processing unit 115 (FIG. 12).

The output of the differential amplifier 126 is also connected through a diode D10 to the non-inverting input of comparator circuit 140 which comprises the polarity detect circuit 82. Comparator circuit 140 has its inverting input connected to a reference potential established by resistor R36 and resistor R33 which are connected in series between +V and ground. The positive input of comparator circuit 140 is also connected through parallel connected resistor R32 and capacitor C27 to ground. The output of the comparator circuit 140 is connected through resistor R28 to +V. The output of the comparator circuit 140 is connected through conductor T1 to port P3.5 of the central processing unit 115 (FIG. 12).

Referring to FIG. 12, the inductive hybrid circuit 90 is connected through conductor interrupt INT0 to port P3.2 of the central processing unit 115. The interface module 11 has the ability to output the engine data it has obtained on port liens P1.7, P3.6 and P3.7. The number one output is provided at port P2.7 which is connected through conductor P27, inverter 191*a* and resistor R30 to lead 26.

Referring now to FIG. 14, the characterization circuit 84 includes a select circuit 151 having input pairs 151-X0, 151-X1, 151-Y0, 151-Y1, 151-Z0, 151-Z1, select inputs 151-A-C and outputs 151-X-Z. Input 151-Z1 is connected to the output of buffer amplifier 124 to receive the secondary pattern signals on the white coded lead 22. The white coded lead 22 is also connected through operational amplifier 152, which comprises inverter 98, to input 151-Z0. Select inputs 151-A-C are connected through leads P11, P12 and P16, to ports P1.1, P1.2 and P1.6, respectively of the central processing unit 115 (FIG. 12).

Output 151-X is connected to the inverting input of operational amplifier 154 which together with network 155 comprises the fast peak and hold circuit 100. Amplifier 154 has its non-inverting input connected to output 151-Z of the analog switch 151 and its output connected to the junction of diodes D1 and D2 which are connected between ground and the inverting input of amplifier 154, with a capacitor C11 connected in parallel with the series connected diodes. The signal output of network 155 is extended through buffer amplifier 156 to the input of the peak/hold select circuit 101 which comprises an analog switch 160 having inputs 160-X0, X1, 160-Y0, Y1 and 160-Z0, Z1; select inputs 160-A-C and outputs 160-X-Z. The other inputs 151-X0 and 151-Y0 are left open, preventing signals from passing through the select circuit 151 while a sample is being held, thereby preventing other signals from interfering with the signal sample being held.

The reset input for the fast peak and hold circuit 100 is provided by output 151-X of the analog switch 151 which has its input 151-X1 connected to ground. When input 151-X is selected, the capacitor C11 is grounded at both sides, providing a discharge path for the capacitor C11.

Inputs 160-X0 and 160-Z0 are connected to the output of amplifier 156 and inputs 160-X1, 160-Y1 and 160-Z1 are connected to ground. Input 160-A selects input 160-X0 and output 160-X, selecting the slow peak and hold circuit 102. Select input 160-C selects input 160-Z0 and output 160-Z, selecting the slow peak and hold circuit 103. Input 160-Y is the reset for the slow peak and hold circuit 102, input 160-Y1 being connected to ground. Select output 160-Z selects the other slow peak and hold circuit 103. Select inputs 160A-160C are connected through conductors P10, P14 and P15 to ports P1.0, P1.4 and P1.5 of the central processing unit 115. Analog switch 151 via output 151-Y provides reset for peak and hold circuit 102, grounding the ungrounded terminal of capacitor C8 when input 151-Y is selected. The slow peak and hold circuits 102 and 103 are identical to peak and hold circuit 100, except for the value of capacitors C8 and C10 which are greater than the value for capacitor C11, each including operational amplifier 171, 172 and an associated network 173, 174 including diodes D6 and D7 and parallel connected capacitor C10 for peak and hold circuit 102 and diodes D4 and D5 and parallel connected capacitor C8 for peak and hold circuit 103. The outputs of the peak and hold circuits 102 and 103 are passed through respective buffer amplifiers 177, 178 to the input of the peak compare circuit 104 which is comprised of a comparator amplifier 180, the output of which is connected to +V through a resistor R3 and through an inverting amplifier 181 and conductor P20 to port P2.0 of the central processing unit 115.

Referring again to FIG. 12, the primary sync generator 86 includes NOR gate 86*a* which has one input connected in series with inverter 191 to the output IN1 of the sync generator circuit and a second input connected through conductor P25 to port P2.5 of the central processing unit 115. The output of NOR gate is passed through resistor R10 to the base of transistor Q1 which has its collector connected to the base of a transistor Q2 and its emitter connected to ground. Transistor Q2 has its emitter connected to a source of +200 V DC and its collector connected to output lead 27.

The primary sync compare circuit 190 comprises a comparator circuit 192 having its non-inverting input connected to a voltage divider defined by resistor R40 and resistor R51 which are connected in series between the primary sync output at lead 27 and ground. A reference voltage is established for the comparator circuit 192 by resistors R39 and R43 which are connected in series between voltage +V and ground, the inverting input of the comparator circuit 192 being connected to the junction of the two resistors. A resistor R49 is connected between +V and the output of the comparator circuit 192 which is connected through conductor P26 to port P2.6 of the central processing unit 115.

Referring to FIGS. 11 and 12, the true/wasted switch input to the microprocessor 85 is through port P2.4 and conductor P24. The fuel switch input is through port P2.1 and conductor P21.

The overall operation of the interface unit 10 has been described hereinabove, the following is a brief description of the sequencing of the central processing unit 115 in processing engine data.

Referring to FIGS. 6 and 12–14, once the number of cylinders has been determined, the processor responds to the next number one interrupt occurring at T1 to prepare to start sampling the secondary signals for the first cylinder in the firing order, cylinder #1 in this example. At time T2, two more cylinder firings have occurred with cylinder sync pulses being received at port P3.3, and at time T2', between time T2 and T3, the processor readies the characterization circuit, clearing output ports P1.0, P1.1 and P1.4 to ready up the number one peak and hold circuit 102, set up the input to the fast peak and hold circuit 100 and to set up the input to peak and hold circuit 102. At time T3, the next number one interrupt is detected. At time T3', approximately midway between time T3 and the next cylinder firing, the processor sets port P1.4 to enable the slow peak and hold circuit 102 to hold the first sample of the number one cylinder, the processor sets port P1.1, P1.2 and P1.5 to reset the fast peak and hold circuit 100 and to reset the slow peak and hold circuit 103. At time T4', midway between the firing of cylinder number 3 and the next number one firing, the processor clears P1.1, P1.2 and P1.5 to ready up the second peak and hold circuit 103 and sets up the fast peak and hold circuit 100 and to set up the input to peak and hold circuit 103. Then following the next number one sync pulse at time T5, at time T5' the processor sets port P1.5 to hold the second sample for cylinder #1. The processor also reads the signal at port P2.0 which is the output of the peak compare circuit 104. Also, all of the peak and hold circuits are reset, the processor setting ports P1.0, P1.1 and P1.2 to effect reset of the fast peak and hold circuit 100 and the slow peak and hold circuits 102 and 103.

The same sequence of operation is carried out for cylinders 2 and 3, except for the timing of the initiation of the operations relative to the time of occurrence of the number one sync pulses. That is, the first sampling sequence for cylinder #2 is initiated in response to the #1 sync pulse generated at time T7' at which time the fast peak and hold circuit 100 and the slow peak and hold circuit 102 are initialized. The first sampling for cylinder #2 is take at time T8', which is the next cylinder firing. Two firings later, the fast peak and hold circuit 100 and the slow peak and hold circuit 103 are reset and at the next cylinder firing, the second sample for cylinder #2 is taken. The central processing unit 115 then reads the output of the peak compare circuit 104. The process for sampling the secondary waveforms for cylinder #3 is similar except that its time is indexed to the time of occurrence of the secondary waveforms for the #3 cylinder, the circuits being initialized at the time of occurrence of the #2 cylinder firing.

When the cylinder characterization information and engine polarity information is obtained, the central processing unit 115 sets ports P2.2, P2.3 and P2.4 to output the appropriate secondary waveform pattern parade for application to the engine analyzer 18 (FIG. 2).

We claim:

1. A distributorless ignition interface unit for use with an engine analyzer for analyzing an internal combustion engine which produces a series of analog signals, including positive polarity signals representing true and wasted firings for a first plurality of cylinders of the engine and negative polarity signals representing true and wasted firings for a second plurality of cylinders of the engine, comprising waveform selection means for conducting the analog signals from an input of the interface unit to an output of the interface unit;

means responsive to the analog signals for determining the number of cylinders of the engine;

polarity detect means responsive to the analog signals for determining the polarity of each analog signal;

characterization means responsive to the analog signals for determining the order of the signals in the series;

and processing means responsive to said characterization means, said means for determining the number of cylinders and to said polarity detect means for controlling said waveform selection means for conducting selected ones of the signals of said series of signals to the output of the interface unit.

2. The interface unit of claim 1, which includes input means for supplying the signals produced by the engine to the interface unit over first and second inputs, each series of signals including signals representing true firings and wasted firings, said waveform selection means including select means operable to select from each series of input signals the signals representing true firings to provide a first parade pattern of signals and the signals representing wasted firings to provide a second parade pattern of signals, and said processing means controlling said select means to select one of the parade patterns of signals to be conducted to the output of the interface unit.

3. The interface unit of claim 2, wherein said waveform selection means further comprises inversion select means interposed between the output of said select means and the output of the interface unit and controlled by said processing means to provide signals of the same polarity for the parade pattern of signals conducted to the output of the interface unit.

4. The interface unit of claim 2, wherein the characterization means uses only the analog signals supplied to the interface unit on one of said inputs in characterizing the engine.

5. The interface unit of claim 1, wherein said characterization means comprises sample and hold means for capturing the KV peak value of the analog signals produced for a given cylinder for true and wasted firings thereof during an engine cycle and for determining which of the peak values for signals produced as the result of the true and wasted firings is of greater amplitude to determine the relative location of the true and wasted firings in the firing order for the given cylinder.

6. The interface unit of claim 5, wherein said sample and hold means includes a first sample and hold circuit, a second sample and hold circuit and select means for passing the first analog signal produced for the first firing of the given cylinder to the first sample and hold means and for passing the second analog signal produced by the second firing of the selected cylinder to the second sample and hold means; said processing means controlling said select means as a function of the amplitude determined by said polarity detect means.

7. The interface unit of claim 6, wherein said sample and hold means further comprises comparator means for comparing the signals produced by said first and second sample and hold means to determine which signal is of greater amplitude.

8. The interface unit of claim 7, wherein said sample and hold means includes further peak and hold means for capturing the fast rise time for the peak value of the signals, said select means extending the sample signal produced by said further peak and hold means for the first cylinder firing to said first sample and hold means and extending the second sample produced by said further peak and hold means for the second cylinder firing to the second sample and hold means.

9. The interface unit of claim 8, which includes inverter means and further select means for connecting said inverter means in circuit with said first input lead for inverting the signals extended to said peak and hold means, said further select means being controlled by said processing means as a function of said polarity detection means.

10. The interface unit of claim 1, wherein said means for determining the number of cylinders comprises pulse generating means for generating a pulse in response to the analog signal produced in response to the firing of each cylinder, signal combining means responsive to the analog signals applied over said first and second inputs for combining the analog signals produced for a given firing of the cylinder prior to application of the analog signals to said polarity detect means and said pulse generating means.

11. The interface unit of claim 1, further comprising primary synchronization pulse generating means, said means for determining the number of cylinders enabling said primary synchronization pulse generating means to generate a synchronization pulse for application to the engine analyzer and said processing means controlling said primary synchronization pulse generating means to control the period of time that the synchronization pulse is provided.

12. The interface unit of claim 1, further comprising means responsive to the engine analog signals for defining engine cycle times for the engine under test.

13. The interface unit of claim 1, wherein the analog signals produced as a result of cylinder firings for a first plurality of cylinders are used in determining the polarity of the firings for all of the cylinders.

14. The interface unit of claim 1, wherein said processing means times the duration of each cylinder firing period.

15. The interface unit according to claim 1, further comprising select means manually operable for controlling said processing means to select true or wasted firing signals to be conducted to the output of the interface unit.

16. The interface unit of claim 1, wherein said waveform selection means further comprises switch means controlled by said processing means for causing the engine analyzer unit to provide a straight line display during the time the engine is being characterized.

17. The interface unit of claim 1, wherein said input means comprises a first plurality of input leads for coupling ignition signals produced by certain ones of the cylinders commonly to a single input of the interface unit and a second plurality of leads for coupling ignition signals produced by certain other ones of the cylinders commonly to a second input of the interface unit.

18. The interface unit of claim 17, wherein said first plurality of leads are coupled to positive firing cylinders and said second plurality of leads are coupled to negative firing cylinders.

19. The interface unit of claim 17, wherein said input means includes terminal block means having a first plurality of inputs and means interconnecting said plurality of inputs to provide a common output, said terminal block means having a second plurality of inputs and means interconnecting said second plurality of inputs to provide a second common output, said first plurality of leads being connected to said first plurality of inputs and said second plurality of leads being connected to said second plurality of inputs.

20. The interface unit of claim 19, wherein said leads are removably connectable to said terminal block means.

21. A distributorless ignition interface unit for use with an engine analyzer for analyzing an internal combustion engine, the engine producing analog signals including a first series of analog signals produced by positive firing cylinders representing true firings and wasted firings of the positive firing cylinders of the engine and a second series of analog signals produced by negative firing cylinders representing true firings and wasted firings of the negative firing cylinders, comprising input means including a plurality of test leads for coupling first and second inputs of the interface unit to spark plug wires associated with cylinders of the engine under test;

pulse generating means responsive to the analog signals for generating a train of pulses in which the number of pulses correspond to the number of cylinders of the engine;

polarity detect means responsive to the analog signals to provide an output signal indicative of the polarity of each analog signal;

characterization circuit means for providing an output signal indicative of the relative location in at least one series of signals of the analog signals representing true and wasted firings for at least one cylinder;

waveform selection circuit means for selectively conducting the analog signals to the engine analyzer;

and processing means responsive to the pulse train provided by said pulse generating means, and the output signals provided by said polarity detection means and said characterization means for controlling said waveform selection circuit means to pass only selected ones of the analog signals to the engine analyzer.

22. The interface unit of claim 21, wherein the characterization circuit means uses only the signals on one of said first and second inputs in characterizing the engine.

23. The interface unit of claim 21, wherein the signals produced as a result of cylinder firings for a first plurality of cylinders are used in determining the polarity of the firings for all of the cylinders.

24. A method for analyzing an internal combustion engine having a distributorless ignition system which produces analog signals representing true and wasted firings for each cylinder of the engine during each engine cycle, the signals being produced in a series of signals with certain ones of the signals having negative polarities and the remaining signals having positive polarities, the method comprising generating a timing signal indicative of the duration of an engine cycle;

detecting the polarity of each analog signal produced by the engine under test during a given engine cycle;

detecting the number of analog signals produced by the engine during a given engine cycle;

characterizing the engine by determining the order of the true and wasted firings for at least certain ones of the cylinders during at least one engine cycle;

and selecting certain ones of the analog signals to be extended to the engine analyzer in a series as a function of the number of cylinders, the polarity of the signals and the characterization of the engine.

25. The method of claim 24, wherein characterizing signals includes sampling the peak value of the signal generated as the result of the firing of a given cylinder into the compression stroke and into the exhaust stroke, and determining which firing occurs first in time.

26. The method of claim 24, wherein selecting the signals which are passed to the engine analyzer includes separating the signals representing the true firings from the signals representing the wasted firings and passing the signals of only one group to the engine analyzer.

27. The method of claim 26, wherein selecting the signals further includes inverting negative plurality signals in the selected group whereby only positive plurality signals are extended to the engine analyzer.

28. The method of claim 24, which further comprises preventing waveform signals from being conducted to the engine analyzer for display during the time interval that the characterization is being carried out.

* * * * *